US006474886B1

(12) United States Patent
Sugiyama et al.

(10) Patent No.: US 6,474,886 B1
(45) Date of Patent: Nov. 5, 2002

(54) COLOR PRINTER AND METHOD OF FEEDING PAPER BY TENSION ROLLERS

(75) Inventors: Hayami Sugiyama; Kenichi Kawahara; Sigeyuki Kawamura; Minoru Yamakuni; Hiroshi Matsuda; Takasi Kubota; Kazunori Masukawa, all of Ise (JP)

(73) Assignee: Shinko Electric Co., Ltd., Tokyo (JP)

( * ) Notice: Subject to any disclaimer, the term of this patent is extended or adjusted under 35 U.S.C. 154(b) by 0 days.

(21) Appl. No.: 09/523,275

(22) Filed: Mar. 10, 2000

(30) Foreign Application Priority Data

Mar. 16, 1999 (JP) ..... 11-071032
Apr. 13, 1999 (JP) ..... 11-105914
Nov. 18, 1999 (JP) ..... 11-328818

(51) Int. Cl.[7] ..... B41J 13/02
(52) U.S. Cl. ..... 400/634; 400/617; 400/618; 400/636; 226/195
(58) Field of Search ..... 400/634, 635, 400/636, 611, 629, 617, 618; 101/181, 228, 248; 347/173, 174, 175, 217, 218; 226/2, 24, 27, 28, 34, 38, 195; 242/416, 419

(56) References Cited

U.S. PATENT DOCUMENTS 3,825,722 A 7/1974 Taniguchi ..... 347/200
4,499,529 A 2/1985 Figueroa ..... 362/283
5,172,136 A 12/1992 Stephenson, III ..... 347/173
5,386,772 A 2/1995 Tolle et al. ..... 101/248
5,549,401 A 8/1996 Ishikawa et al. ..... 400/618
5,847,742 A 12/1998 Nishimura ..... 347/173
5,937,756 A * 8/1999 Kishine et al. ..... 101/228

FOREIGN PATENT DOCUMENTS

| | | |
|---|---|---|
| DE | 1115656 | 10/1961 |
| DE | 2459643 | 6/1976 |
| EP | 0140690 | 5/1985 |
| EP | 0562285 | 9/1993 |
| EP | 0673776 A1 | 9/1995 |
| JP | 61031268 | 2/1986 |
| JP | 61181659 | 8/1986 |
| JP | 62117763 | 5/1987 |
| JP | 64-58566 | 6/1989 |
| JP | 03047771 | 2/1991 |
| JP | 08194343 | 7/1996 |
| JP | 09216390 | 8/1997 |
| JP | 09216391 | 8/1997 |
| JP | 10138541 | 5/1998 |
| JP | 10138547 | 5/1998 |
| JP | 10315518 | 12/1998 |

* cited by examiner

*Primary Examiner*—Andrew H. Hirshfeld
*Assistant Examiner*—Minh H. Chau
(74) *Attorney, Agent, or Firm*—Darby & Darby

(57) ABSTRACT

In the present invention, the recording paper is conveyed by a feed roller to plural recording portions sequentially, and each recording portion successively prints each specific color on the recording paper while applying tension to the paper. The tension applied to the recording paper is switched to a predetermined value each time the recording paper is conveyed to each recording, portion when starting to print.

9 Claims, 17 Drawing Sheets

FIG. 9

| TENSION ROLLER | TIMING 1 PRINTING YELLOW FOR FIRST PARTION OF PAPER | TIMING 2 PRINTING MAGENTA FOR FIRST PARTION OF PAPER | TIMING 3 PRINTING CYAN FOR FIRST PARTION OF PAPER | TIMING 4 OVER COAT TREATMENT FORFIRST PARTION OF PAPER |
|---|---|---|---|---|
| F1 | $T+\alpha T$ | T | T | T |
| F2 | 0 | $T+\alpha T$ | T | T |
| F3 | 0 | 0 | $T+\alpha T$ | T |
| F4 | 0 | 0 | 0 | $T+\alpha T$ |
| T0 | $\alpha T$ | $\alpha T$ | $\alpha T$ | $\alpha T$ |

COLOR PRINTER AND METHOD OF FEEDING PAPER BY TENSION ROLLERS

BACKGROUND OF THE INVENTION

1. Field of the Invention

The present invention generally relates to a color printer for printing a full color image with plural thermal heads, and further relates to preventing the shear of the colors in printing, such as errors in dot positioning. Also, the present invention generally relates to paper feeding of color printers with plural thermal heads so as to prevent shear of the colors in printing.

Also, the invention generally relates to thermal heads, which are very useful for the above mentioned color printers, and which can be used in double-line thermal heads or preheat-type thermal heads. The present invention also generally relates to methods of making the thermal heads.

Furthermore, the invention generally relates to a lamp reflection board which reflects light from a lamp to thermal paper, and further relates to a small instrument such as the above mentioned color printer, in which it is very difficult to secure a sufficient optical path length.

2. Description of Related Art

Color Printer

There are many types of color printers, such as thermal transfer printers, ink-jet printers, and so on. Thermal transfer printers transfer ink from an ink ribbon onto recording paper by placing the ink ribbon against the recording paper, heating the thermal head and pressing it against the ink ribbon.

Recently, customers have required high speed printing from thermal transfer color printers. But the maximum printing speed is limited by four elements, i.e., as the characteristics of the ink ribbon dye, development of wrinkles, data transfer speed, and the response speed of the thermal head.

FIG. 1 illustrates a general block diagram of a conventional color printer. A conventional color printer has three thermal heads for three colors of ink ribbons, which are yellow, magenta, and cyan ribbons. The conventional color printer uses roll paper or cut paper of a long length for recording paper 3. This color printer 1 has four print portions 1*a*, 1*b*, 1*c*, and 1*d*. The first print portion la prints yellow ink onto the recording paper 3. The second print portion 1*b* prints magenta ink onto the recording paper 3. The third print portion 1*c* prints cyan ink onto the recording paper 3. The fourth print portion 1*d* overcoats the recording paper 3 after yellow, magenta, and cyan ink are printed onto the recording paper 3.

The recording paper 3 is conveyed from paper roll 2 by feed roller 4 and pinch roller 5. The feed roller 4 has a small protuberance on its surface, and is driven by a pulse motor (not shown in FIG. 1). Downstream of the fourth print portion id, there is a paper discharging roller 6 for discharging the recording paper 3, and cutter 8 for cutting the recording paper 3 to a pre-determined length.

Each print portion 1*a*, 1*b*, 1*c* has thermal heads 9*a*, 9*b*, 9*c*, platen rollers 10*a*, 10*b*, 10*c*, ink ribbon supply rollers 12*a*, 12*b*, 12*c*, ink ribbon take-up rollers 13*a*, 13*b*, 13*c*, tension rollers 14*a*, 14*b*, 14*c*, and pinch rollers 15*a*, 15*b*, 15*c*. The platen rollers 10*a*, 10*b*, 10*c* are located opposite the print portions 1*a*, 1*b*, 1*c*, respectively. The ink ribbon supply rollers 12*a*, 12*b*, 12*c* supply each color of ink ribbon 11*a*, 11*b*, 11*c* to the respective thermal heads 9*a*, 9*b*, 9*c*. The ink ribbon take-up rollers 13*a*, 13*b*, 13*c* respectively take up each color of ink ribbon 11*a*, 11*b*, 11*c*. The tension rollers 14*a*, 14*b*, 14*c* are located downstream of the respective thermal heads 9*a*, 9*b*, 9*c*. The pinch rollers 15*a*, 15*b*, 15*c* are located opposite the tension rollers 14*a*, 14*b*, 14*c*, respectively.

Similar to each print portion 1*a*, 1*b*, 1*c*, the overcoat portion 1*d* has thermal head 9*d*, platen roller 10*d*, overcoat ribbon 11*d*, overcoat ribbon supply roller 12*d*, overcoat ribbon take-up roller 13*d*, tension roller 14*d*, and pinch roller 15*d*. The overcoat ribbon supply roller 12*d* supplies overcoat ribbon 11*d* to the thermal head 9*d*. The overcoat ribbon take-up roller 13*d* takes up the overcoat ribbon 11*d*. The tension roller 14*d* is located downstream of the thermal head 9*d*. The pinch roller 15*d* is located opposite the tension roller 14*d*.

F1, F2, F3, and F4 indicate the thrust tension of each of tension rollers 14*a*, 14*b*, 14*c*, and 14*d*. W1, W2, W3, and W4 indicate the frictional forces of each thermal transfer mechanism. T0 indicates the tension of the feed roller 4, and T1, T2, T3, and T4 indicate the tension of the paper 3 between the tension rollers 14*a*, 14*b*, 14*c*, 14*d* and the thermal heads 9*a*, 9*b*, 9*c*, 9*d* at the print portions 1*a*, 1*b*, 1*c* and overcoat portion 1*d*.

At the above mentioned color printer 1, the front edge of paper 3 pulled out from paper roll 2 is conveyed between feed roller 4 and pinch roller 5 by a paper feeding mechanism (not shown in FIG. 1). Then the front edge of paper 3 is caught between feed roller 4 and pinch roller 5, passes between the thermal head 9*a* and platen roller 10*a*, and is conveyed to a location between tension roller 14*a* and pinch roller 15*a*.

At this point, the thermal head 9*a* is pressed against platen roller 10*a* sandwiching the paper 3, and pinch roller 16*a* is pressed against tension roller 14*a* sandwiching the paper 3. Then, tension roller 14*a* is driven by a DC motor (not shown in FIG. 1) with constant tension, and at the same time yellow ink is transferred onto paper 3 by the heat of the thermal head 9*a*. Yellow ink ribbon 11*a* wound around the ink ribbon supply roller 12*a* is moved downstream of the printer in synchronization with the printing speed. The ink ribbon take-up roller 13*a* takes up the transferred ink ribbon 11*a*.

After the yellow image printing is over, the front edge of paper 3 reaches a location between tension roller 14*a* and pinch roller 15*a*. At this point, the thermal head 9*b* is pressed into platen roller 10*b* sandwiching the paper 3, and pinch roller 15*b* is pressed into tension roller 14*b* sandwiching the paper 3. Then, tension roller 14*b* is driven by a DC motor (not shown in FIG. 1) with constant tension, and at the same time magenta ink is transferred onto paper 3 by the heat of the thermal head 9*b*. Magenta ink ribbon 11*b* wound around the ink ribbon supply roller 12*b* is moved downstream of the printer in synchronization with the printing speed. The ink ribbon take-up roller 13*b* takes up the transferred ink ribbon 11*b*. When a first magenta image is printed on a first portion of the paper 3 at the thermal head 9*b*, a second yellow image is printed on a second portion of the paper 3 at the thermal head 9*a*.

After the magenta image printing is over, the front edge of paper 3 reaches the location between tension roller 14*c* and pinch roller 15*c*. At this point, tension roller 14*c* is driven by a DC motor (not shown in FIG. 1) with constant tension, and at the same time cyan ink is transferred onto paper 3 by the heat of the thermal head 9*c*. Then the front edge of paper 3 reaches the location between tension roller 14*d* and pinch roller 15*d*. When the first cyan image is printed on first portion of the paper 3 at the thermal head 9*c*, the second magenta image is printed on a second portion of the paper 3 at the thermal head 9*b*, and the third yellow image is printed on a third portion of the paper 3 at the thermal head 9*a*.

When the front edge of paper 3 reaches the location between tension roller 14*d* and pinch roller 15*d*, the thermal head 9*d* is pressed against platen roller 10*d* sandwiching the paper 3, and pinch roller 15*d* is pressed against tension roller 14*d*, sandwiching the paper 3. Then, tension roller 14*d* is driven by a DC motor (not shown in FIG. 1) with constant tension, and at the same time an overcoat print is executed with heat of the thermal head 9*d* on paper 3, which has been printed with a yellow image, magenta image, and cyan image. And overcoat ribbon lid wound around overcoat ribbon supply roller 12*d* is moved downstream of the printer in synchronization with the printing speed. The overcoat ribbon take-up roller 13*d* takes up the transferred overcoat ribbon 11*d*.

When overcoat is printed on a first portion of the paper 3 at the thermal head 9*d*, the second cyan image is printed on a second portion of the paper 3 at the thermal head 9*c*, the third magenta image is printed on a third portion of the paper 3 at the thermal head 9*b*, and the fourth yellow image is printed on a fourth portion of the paper 3 at the thermal head 9*a*. After overcoat printing is over, the front edge of paper 3 reaches cutter 8, passing through paper discharging roller 6 and pinch roller 7. The cutter 8 cuts the first portion of the paper 3 and a paper storage area (not shown in FIG. 1) stores the first portion of the paper 3, which is printed with a yellow image, magenta image, and cyan image and with an overcoat.

The above mentioned color printer and paper feeding have the following requirements. The first requirement is stability of the tension of the paper 3 during printing. Generally, the thrust tension F1, F2, F3, and F4 of each tension roller 14*a*, 14*b*, 14*c*, and 14*d* are made constant. Therefore, the tension affecting paper 3 and working on feed roller 4 changes incrementally from the first paper printing portion to the third paper printing portion. FIG. 2 illustrates the relation between the tension and the extension of the paper, which is used for sublimation printing with a 230 $\mu$m thickness. The paper is distorted elastically by tension, and this elastic distortion strongly depends on humidity. As shown in FIG. 2, if the tension acting on the paper 3 changes during the printing operation, the change of tension causes paper expansion and contraction, producing shear of the colors in printing.

The second requirement is stability of the conveyance ratio. As shown in FIG. 1, the critical roller to determine conveyance length of paper 3 is feed roller 4 at the paper feeding mechanism. If the tension acting on the paper by feed roller 4 is changed, then the conveyance ratio of paper 3 changes. FIG. 3 shows feed roller 4 and pinch roller 5 feeding paper 3. As shown in FIG. 3, the conveyance ratio is expressed by the following equation, when "R" represents the radius of feed roller 4:

$$\text{conveyance ratio } (\%) = (\text{measured conveyance length}/2\pi R) \times 100 \quad (1)$$

FIG. 4 illustrates the relation between the tension and conveyance ratio. In FIG. 4, a positive sign indicates that the direction of the tension acting on the paper is the same direction as the paper feeding, and a negative sign indicates that the direction of tension acting on the paper is the opposite direction to the direction of paper feeding. If the tension acting on the feed roller 4 changes during printing, the conveyance length of paper 3 changes and that leads to shear of the colors in printing.

To summarize above arguments of the color printer, the changes of the tension acting on the paper cause tension and extension of the paper; as well as a change of the tension acting on the feed roller 4 during continuous printing of a first portion of the paper to a third portion of the paper. Changes in tension acting on the paper result in changes of the conveyance length of the paper, which lead to shear of the colors in printing during the placing of color dots. Next to a third portion of the paper, the shear of the colors in printing is relatively small, because changes in tension occur within a limited range. To avoid shear of the colors for the first three portions of the paper, one conventional solution is to discard the first three portions of the paper without color printing. However, this method causes much waste of paper 3.

The third requirement is to avoid lateral print shading. In the case of a color printer using the thermal transfer method or thermal color development method, the frictional coefficient between the exothermic portion of the thermal head and the paper or ink ribbon fluctuates depending on the energy acting on the exothermic portion and the quantity of heat stored in the thermal head. This fluctuation occurs in each line of printing, and occurs on a millisecond order period in the time domain. This fluctuation of tension on the millisecond order leads to lateral print shading on recording paper 3, which reduces the printing quality. Furthermore, as shown in FIG. 4, if the tension acting feed roller 4 fluctuates during printing, this fluctuation changes the conveyance length of paper 3, which cause shear of the colors in printing.

Thermal Head

Japanese Unexamined Patent Publication, First Publication No. Sho 62-217627 discloses the invention of double line thermal heads, which have plural exothermic resistance portions with two lines in parallel to speed up printing. Double line thermal heads can cut the time for printing in half, in principle, because these thermal heads print two lines at the same time. Japanese Unexamined Patent Publication, First Publication No. Hei 08-300695 discloses an invention of a preheat-type thermal head with a metal plate, which speeds up printing.

However there are some problems with double line thermal heads. The first problem is peeling off at the boundary between the common electrode and alumina base when heating, because the thermal expansion coefficients of the bulk metal of the common electrode and of the alumina base are not the same. The second problem is that peeling off at the boundary of the electrode and alumina base causes thermal stress to the thin-film electrode, which builds up on the common electrode, and the thermal stress can damage the thin film, which has portions with low mechanical strength. Furthermore, peeling off at the boundary of the electrode and alumina base makes it difficult to smoothly connect the common electrode and the alumina base, and the thermal stress breaks the thin film formed on the common electrode.

The third problem is the difficulty in manufacturing a common electrode, which should have positioning accuracy within fine width of the dot level of the thermal head. It is very difficult to connect the common electrode with the alumina base without gaps or openings, and it is very difficult to cover the alumina base with the common electrode without gaps or openings. Even if these problems were overcome, a fourth problem occurs in that is difficult to print with high density with double line thermal heads, because there is the opening between the double lines in exothermic resistance portion, and the width of the opening is coincident to the width of the common electrode.

There are some problems with preheat type thermal heads. The first problem is that it is difficult to complete a predetermined shape precisely for all lengths of substrate in the process of producing a common electrode on a stainless substrate with etching or mechanical processing, with increases the cost. The second problem is that air bubbles remain in the glass glaze. In the process of screen-printing and baking of the glass paste, it is difficult to bake a stainless substrate with a baking temperature as high as that of the ceramic substrate. As the result of the relatively low baking temperature, the viscosity of the glass glaze remains high, and high viscosity hinders elimination of air bubbles in the glass glaze. The third problem is damage to the thin film formed on the common electrode, because air bubbles appear on the surface of common electrode through lapping or polishing of the preheat type thermal head. The fourth problem is that it is difficult to complete the preheat type thermal head with precise lapping or polishing over the entire length of the substrate. The lapping or polishing of the thermal heads is carried out to make the common electrode appear on the surface of the thermal heads.

Even if these problems were solved, a fifth problem would remain, which is a large loss of heat at the common electrode while the paper passes through the first line exothermic resistance portion to reach the second line exothermic resistance portion. The reason for the fifth problem is that the common electrode is located between the double lines of the exothermic resistance portion in the case of a preheat type thermal head.

Lamp Reflex Board

Lamp reflex boards are attached thermal recording devices such as color printers. FIG. 5 illustrates the principal components of a thermal recording device having lamp reflex boards. Paper 3 (TA paper) is discharged by feed roller 4 and pinch roller 5 from paper roll 2. The paper 3 is printed with the three primary colors, that is a yellow image is printed by yellow print module 1*a* and yellow fixing lamp 30*a*, a magenta image is printed by magenta print module 1*b* and magenta fixing lamp 30*b*, and a cyan image is printed by cyan print module 1*c*. Color printed paper 3 is then sent to cutter 8 by paper discharging roller 6 and pinch roller 7, and is cut to a predetermined length by cutter 8 driven by cutter motor 28. Yellow fixing lamp 30*a* and magenta fixing lamp 30*b* have yellow lamp reflex board 40*a* and magenta lamp reflex board 40*b* respectively, and these lamp reflex boards 40*a*, 40*b* make the light emanating from the lamps effectively irradiate the thermal paper 3.

FIG. 6 is a representative diagram of the prior art of lamp reflex board and its catoptric light incident on the thermal paper. The lamp reflex board shown in FIG. 6 is disclosed in Japanese Unexamined Patent Publication, First Publication Nos. Hei 09-216390 and 09-216391 for example. The following are the predetermined conditions for the lamp reflex board. Lamp 30 has a circular section with diameter of 16 mm. A reflex board 40 is attached having seven portions which are symmetrical about the lamp 30. The numbers of the lamp light beams illustrated in FIG. 6 is seventy-one, which are divided by seventy equal angles over a range of 110 degrees.

FIG. 6 shows the positions of connecting points P0, P1, P2, . . . , P7. According to FIG. 6, catoptric light reaches paper 3 with one or two reflections. After the shape of the reflex board 40 is determined in the above mentioned manner, the reflex board 40 is manufactured according to the determined shape. The width W* of the reflex board 40 is the distance between connecting point P7 and connecting point P7*, and it is expressed by following equation based on the diameter D of lamp 30.

$$W^*=3.11D \quad (2)$$

The height H* of reflex board 40 from the surface of paper 3 is expressed by following equation.

$$H^*=1.51D \quad (3)$$

It is desirable for the thermal recording device to be small, to make it easy to secure a place for the thermal recording device. Therefor it is desirable to make the width W* of the reflex board 40 narrow. According to the structure of the thermal recording device in FIG. 6, it is necessary to secure a width W* of reflex board 40 to make light radiated from the back of lamp 30 to reach the surface of the paper with one or two reflections. This makes it difficult to reduce the size of the thermal recording device, because a determined length of the reflection path of the light radiated from the lamp 30 must be provided.

SUMMARY OF THE INVENTION

It is the first object of the present invention to provide a color printer and a method of paper feeding which can prevent shear of the dots of each color arising from stretching of the paper by maintaining the tension acting on the paper constant to within a tolerance level. And it is also the first object of the present invention to provide a color printer and a method of paper feeding which can prevent shear of the dots of each color arising from irregular feeding by maintaining the paper feeding distance constant, which maintains the tension acting on the feed roller constant to within a tolerance level.

It is the second object of the present invention to provide a thermal transfer method or thermal color development method for a color printer which is provides high quality printed image by preventing lateral print shading of the printed image.

It is the third object of the present invention to provide a thermal head and a method of making the same, which is made by a simpler manufacturing process compared with conventional process to manufacture double-line thermal heads and preheat thermal heads.

It is the fourth object of the present invention to provide a thermal head which can print with higher density compared with conventional double-line thermal heads.

It is the fifth object of the present invention to provide a thermal head which has higher heat efficiency compared with conventional preheat thermal heads.

It is the sixth object of the present invention to provide a lamp reflex board, which has small width and which can make the light radiated by the back of the lamp reach the surface of the paper with two or one reflections.

The present invention of a method of paper feeding in a color printer provides an advantageous feature of achieving the first object. In the present invention, the recording paper is conveyed by a feed roller to plural recording portions sequentially, and each recording portion successively prints each specific color on the recording paper while applying tension to the paper. The tension applied to the recording paper is switched to a predetermined value each time the recording paper is conveyed to each recording portion when starting to print.

Therefore the present invention of a method of paper feeding in a color printer can provide a tension applied to the recording paper which is switched to a predetermined value each time the front edge of the recording paper is conveyed to each recording portion when starting to print. For example, when the front edge of the recording paper reaches the first recording portion, a tension is applied to the recording paper in excess of the frictional force experienced by the recording paper at the first recording portion. This provides a tension corresponding to the frictional force experienced by the recording paper at the first recording portion, and a further tension in excess of the frictional force of the feed roller.

When the front edge of the recording paper reaches the second recording portion, the tension at the second recording portion is set to be in excess of the frictional force of the recording paper in the same manner as described above for the first recording portion. At the same time, the tension at the first recording portion is set to correspond to the frictional force on the recording paper. This makes the tension correspond to the frictional force on the recording paper at the first and second recording portions, and provides a tension in excess of the frictional force of the feed roller between the second recording portion and the first recording portion.

The present invention of a color printer provides an advantageous feature of achieving the first object. In the present invention, the color printer comprises a feed roller, plural recording portions, and tension rollers. The feed roller conveys the recording paper. The plural recording portions are located along the paper path downstream of the feed roller, and each prints a specific color ink on the paper. The tension rollers are located downstream of each recording portion, and convey the recording paper from upstream to downstream by applying tension. Furthermore, the tension that the tension rollers apply to the recording paper is switched to a predetermined value each time the recording paper is conveyed to each recording portion.

Therefore the present invention of a color printer can provide a tension applied to the recording paper which is switched to a predetermined value each time the front edge of the recording paper is conveyed to each recording portion when starting to print. For example, when the front edge of the recording paper reaches the recording portion, tension is applied to the recording paper in excess of the frictional force of the recording paper at the recording portion. This makes the tension correspond to the frictional force on the recording paper at the recording portion, and provides a further tension in excess of the frictional force of the feed roller.

The present invention of a color printer also provides the advantageous feature of achieving the second object. In the present invention, the color printer comprises a feed roller, plural recording portions, tension rollers, a frictional force detecting portion, and a driving force control portion. The feed roller conveys the recording paper. The plural recording portions are located along the paper path downstream of the feed roller, and each prints a specific color ink on the paper. The tension rollers are located downstream of each recording portion, and convey the recording paper from upstream to downstream by applying tension. The frictional force-detecting portion detects a frictional force between the thermal head located on the recording portion and the paper during printing. The driving force control portion controls the driving force of the motor to balance the frictional force detected by the frictional force detecting portion and the driving force of the motor driving the tension roller.

The present invention of a thermal head provides the advantageous feature of achieving the third, fourth, and fifth objects. In the present invention, the thermal head comprises a first layer of an electric circuit pattern, an insulator layer, and a second layer of an electric circuit pattern. The first layer of the electric circuit pattern has an electric circuit pattern formed on a ceramic substrate. The insulator layer is formed on the layer of the electric circuit pattern. The second layer of the electric circuit pattern has an electric circuit pattern formed on the insulator layer.

The present invention of a lamp reflex board provides an advantageous feature of achieving the sixth object. In the present invention, the lamp reflex board reflects radiant light from the back and side of the lamp onto an irradiation surface, and comprises a rear reflex board, a rear-side reflex board, and a side reflex board. The rear reflex board is located at the back of the lamp, and it reflects radiant light from the back of the lamp to the side of the lamp. The rear-side reflex board is located to the back and side of the lamp, and it reflects catoptric lights from the rear reflex board onto the irradiation surface. The side reflex board is located to the side of the lamp, and it reflects radiant light from the side of the lamp onto the irradiation surface.

The rear reflex board and rear-side reflex board reflect radiant light from the back of the lamp onto the irradiation surface and the side reflex board reflects radiant light from the side of the lamp to the irradiation surface. Compared with a conventional reflector of a concave mirror, the rear reflex board, rear-side reflex board, and side reflex board are provided as separate pieces. This makes the width of lamp reflex board narrow.

BRIEF DESCRIPTION OF THE DRAWINGS

These and other objects and advantages of this invention will become more apparent and more readily appreciated from the following detailed description of the presently preferred exemplary embodiment of the invention, taken in conjunction with the accompanying drawings, of which:

FIG. 9 shows the switching of the thrust tension of the tension rollers according to the position of the front edge of the recording paper of a color printer of the first embodiment.

DETAILED DESCRIPTION OF THE INVENTION

Embodiment 1: Color Printer

Figure 1:
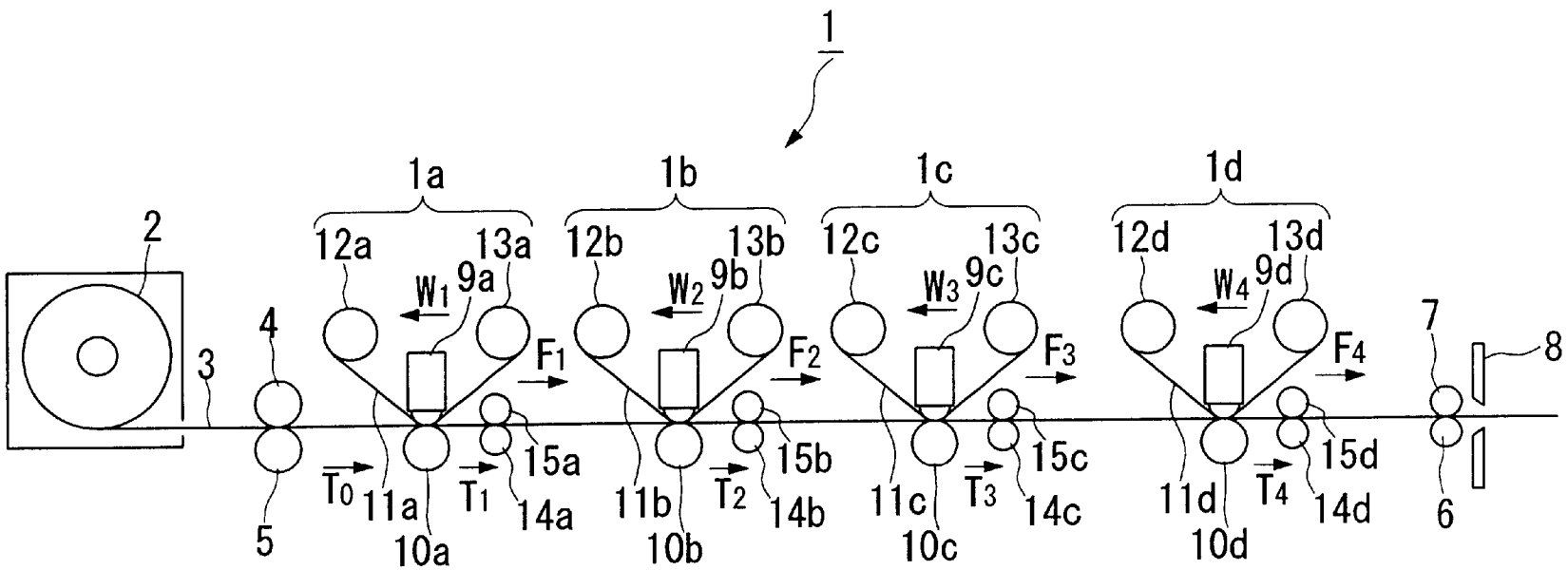
FIG. 1 Prior Art
FIG. 1 illustrates a general block diagram of a conventional color printer.
Figure 2:
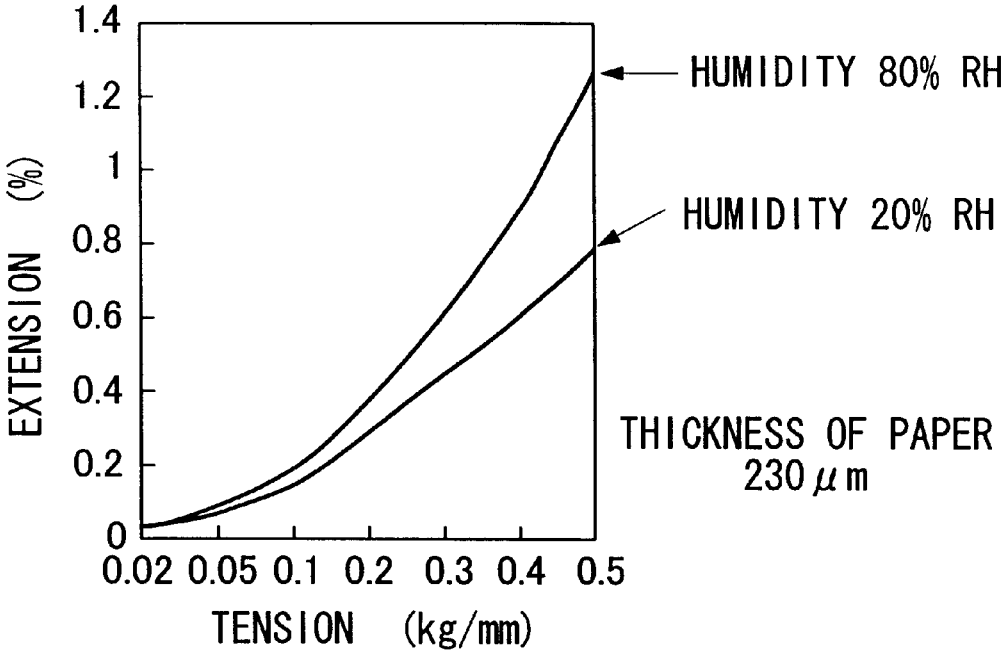
FIG. 2 Prior Art
FIG. 2 illustrates the relation between the tension and the extension of the paper.
Figure 3:
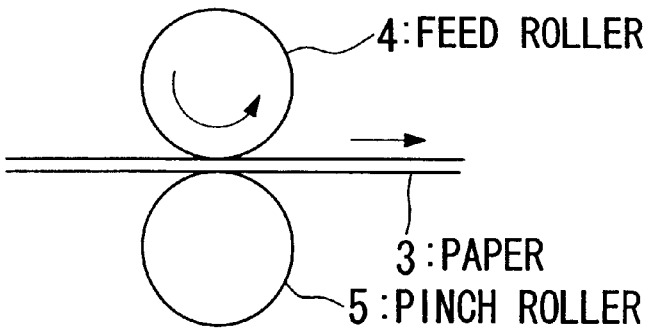
FIG. 3 Prior Art
FIG. 3 shows a feed roller and pinch roller feeding paper.
Figure 4:
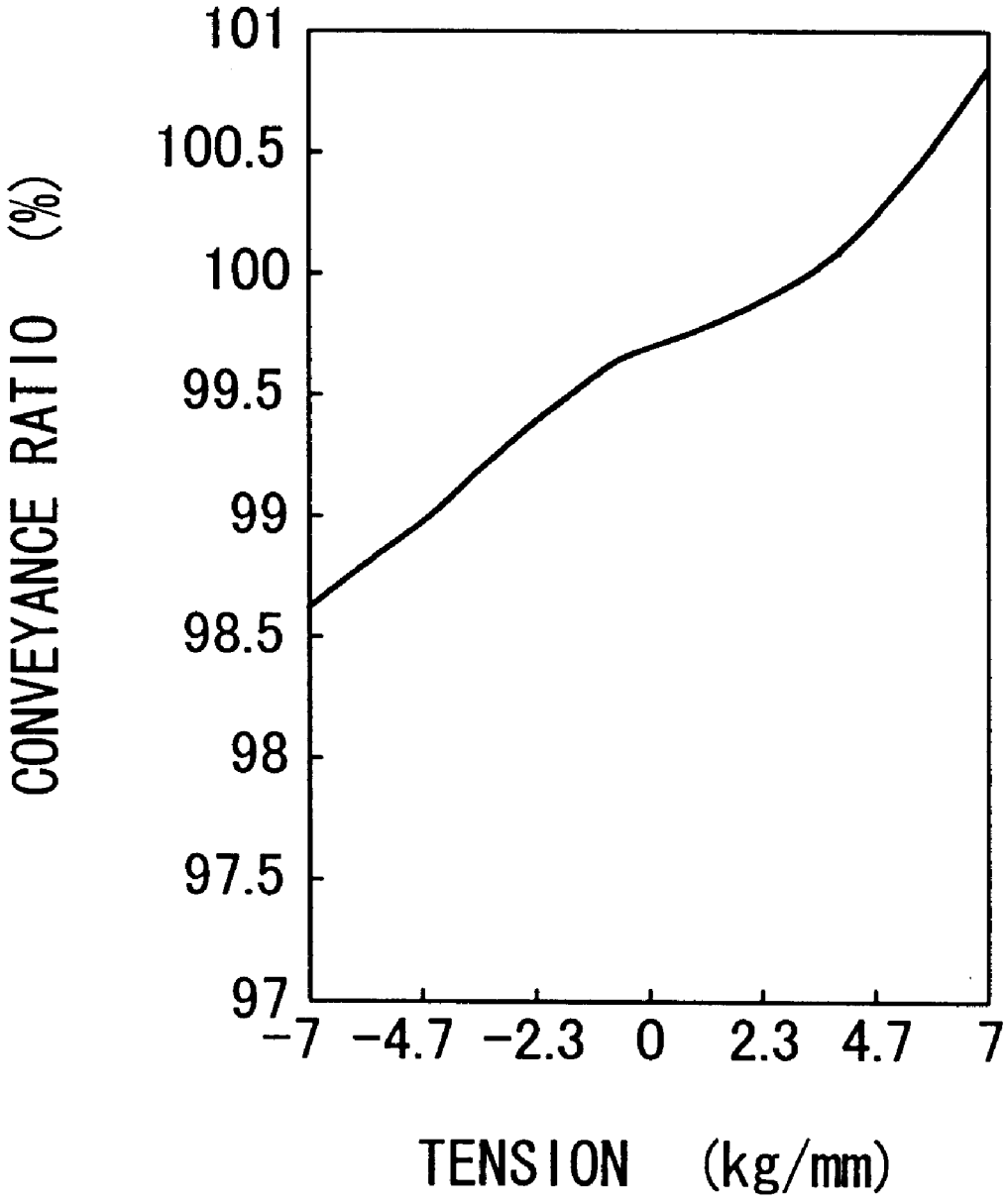
FIG. 4 Prior Art
FIG. 4 illustrates the relation between the tension and the conveyance ratio.
Figure 5:
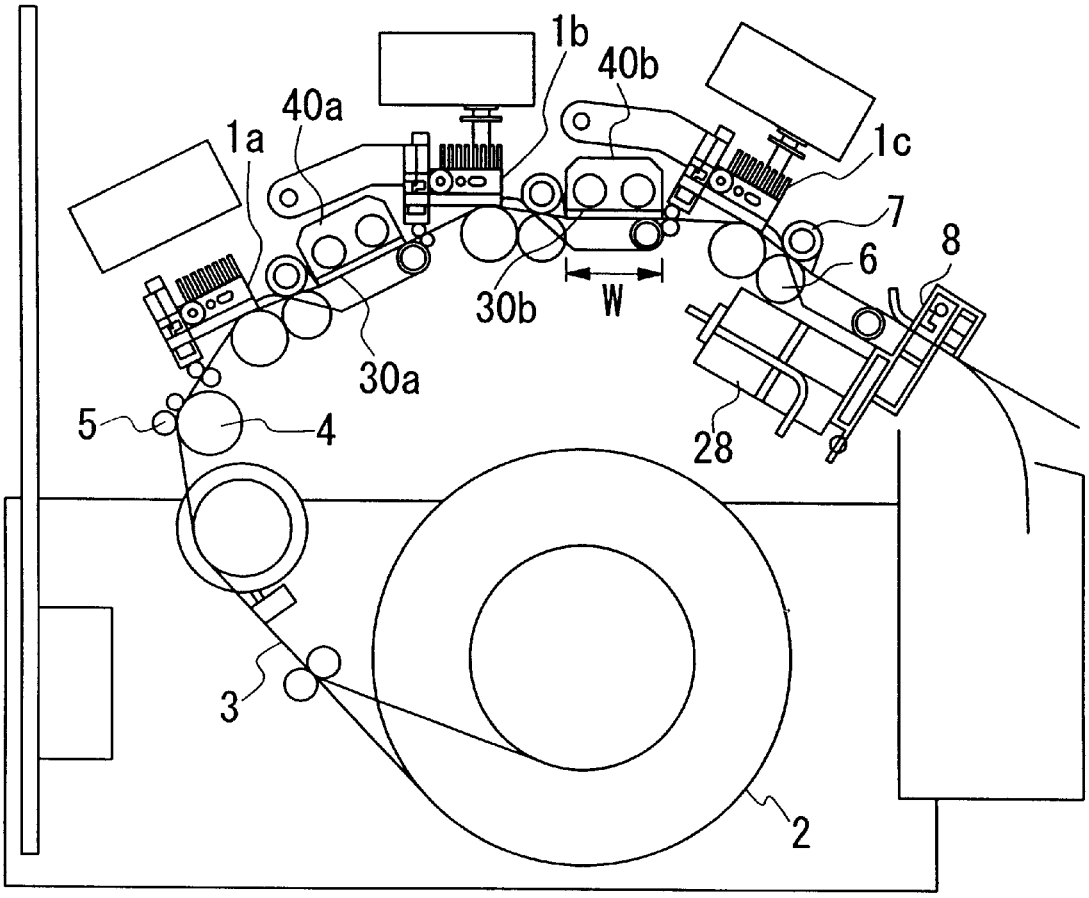
FIG. 5 Prior Art
FIG. 5 illustrates the principal components of a thermal recording device having lamp reflex boards.
Figure 6:
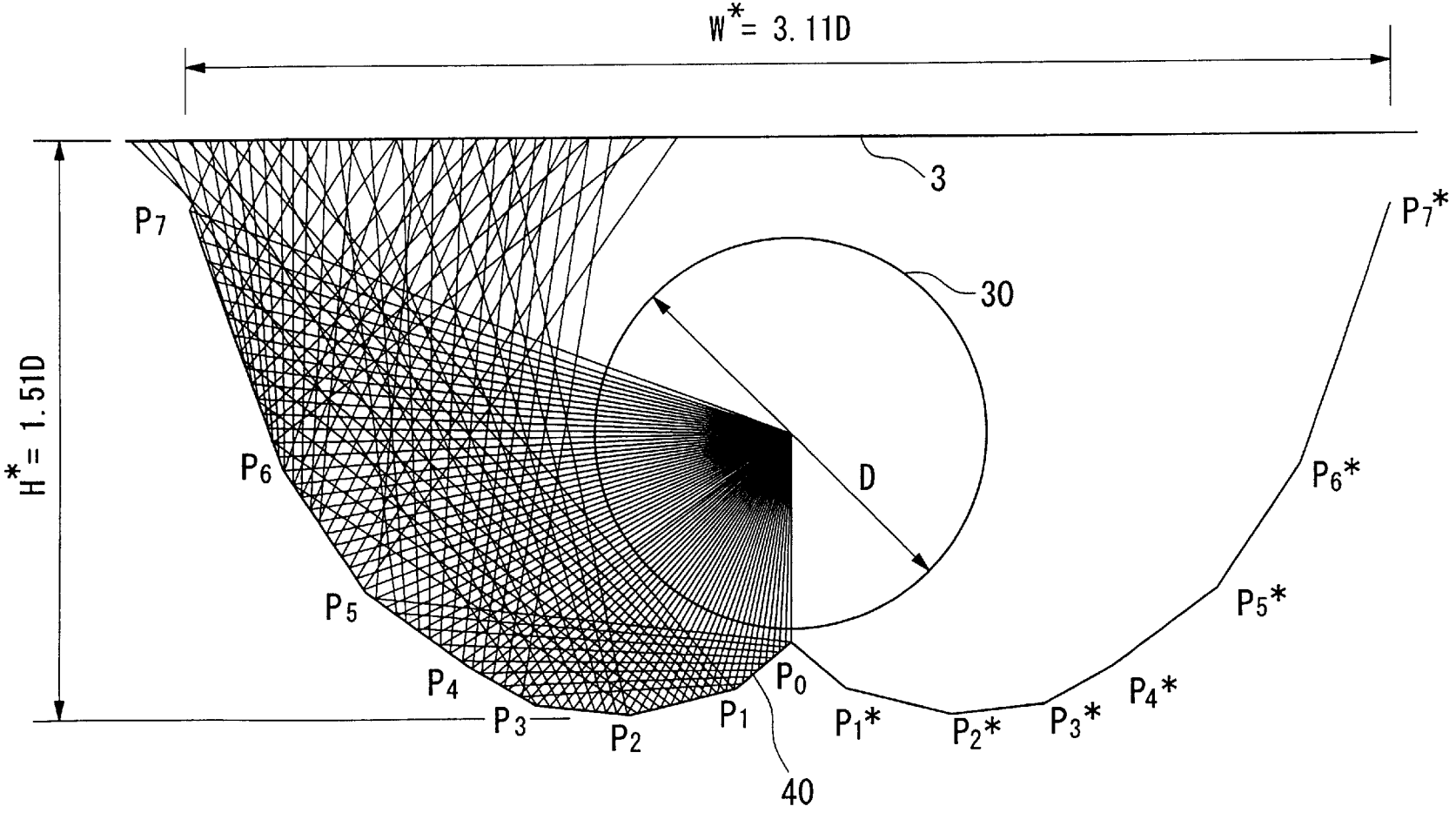
FIG. 6 Prior Art
FIG. 6 is a representative diagram of the prior art of lamp reflex board and its reflection light incident to the thermal paper.
Figure 7:
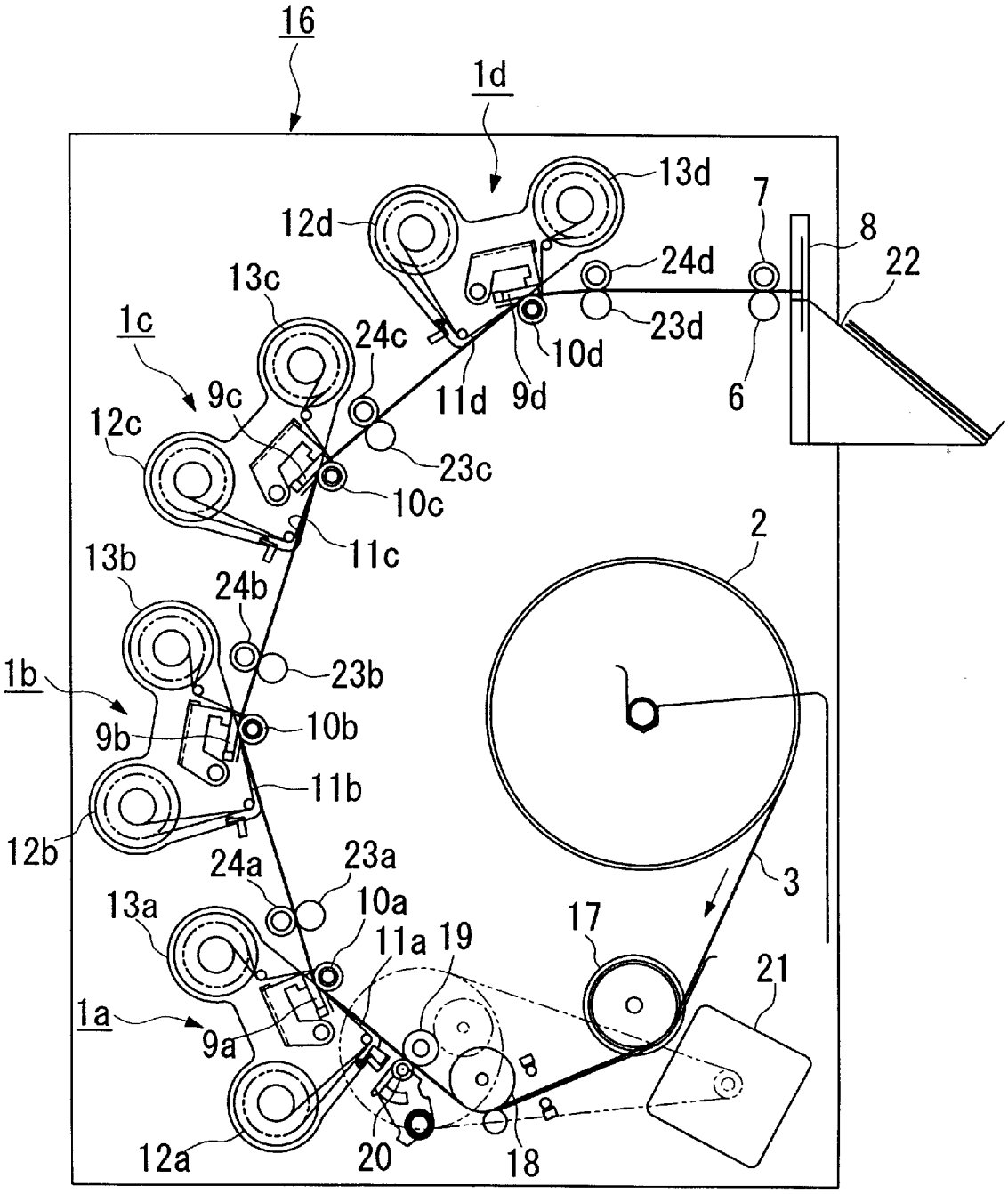
FIG. 7 is a constitutional diagram of the first embodiment of this invention, which is a color printer with a feed roller and print portion.
Figure 8:
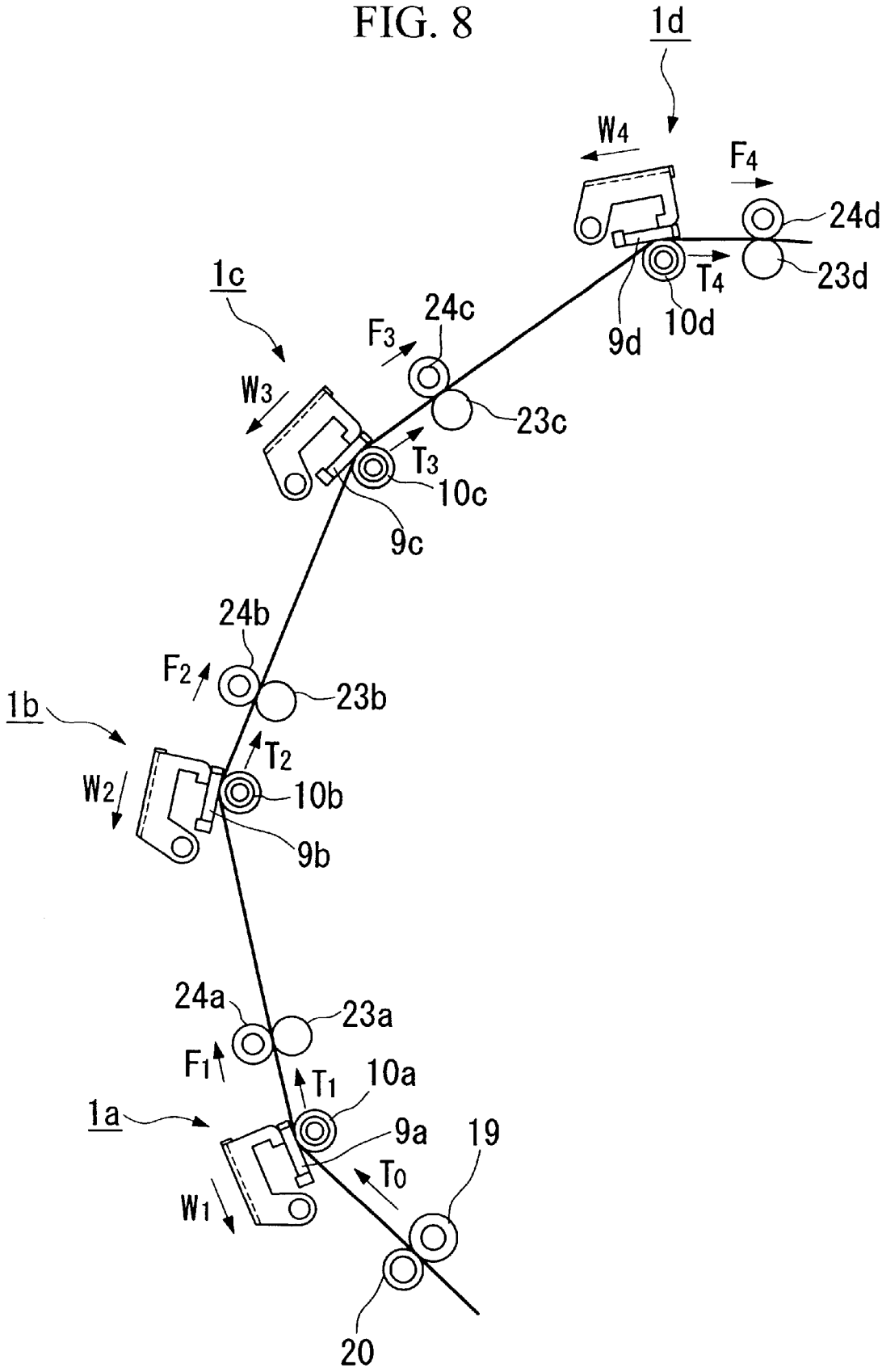
FIG. 8 shows the direction of the thrust tension at a tension roller, and the frictional force and tension acting on paper at a print portion of a color printer of the first embodiment.

From FIG. 7 to FIG. 9, these figures illustrate the first embodiment of this invention for a color printer and a method of paper feeding. In this embodiment, recording portions respectively print three color images on a paper 3, for example a yellow, magenta, and a cyan image. To simplify the explanation, the constitutional elements appearing in FIG. 1 to FIG. 4 are marked with the same numbers in FIG. 7 to FIG. 9.

FIG. 7 is a constitutional diagram of a color printer 16 of the first embodiment of this invention. The elements of the color printer 16 are arranged from upstream to downstream one by one. The elements thus arranged are a paper roll 2, paper guide rollers 17, 18, feed roller 19 to convey the paper 3, print portions (recording portions) 1*a*, 1*b*, 1*c*, overcoat portion 1*d*, paper discharging roller 6 to discharge the paper 3 from a color printer 16, cutter 8 to cut the paper 3 to a predetermined length, and holder 22 to hold the printed paper. The print portions 1*a*, 1*b*, 1*c* are arranged along the path of the paper 3, and print a yellow, magenta, and cyan image respectively on the paper 3. The overcoat portion 1*d* overcoats the printed paper 3 as a post treatment.

The feed roller 19 is arranged opposite pinch roller 20, on the other side of paper 3, and the paper discharging roller 6 is arranged opposite of a pinch roller 7 on the other side of paper 3. The feed roller 19 has small protuberances on its surface, and it is driven so as to revolve by a pulse motor 21. Each print portion 1*a*, 1*b*, 1*c* respectively comprises thermal heads 9*a*, 9*b*, 9*c*; platen rollers 10*a*, 10*b*, 10*c* arranged opposite of the thermal heads 9*a*, 9*b*, 9*c*; ink ribbon supply rollers 12*a*, 12*b*, 12*c* supplying each color of ink ribbon 11*a*, 11*b*, 11*c* to the thermal heads 9*a*, 9*b*, 9*c*; ink ribbon take-up rollers 13*a*, 13*b*, 13*c* taking up the ink ribbon 11*a*, 11*b*, 11*c*. The ink ribbon 11*a* is yellow, the ink ribbon 11*b* is magenta, and the ink ribbon 11*c* is cyan ink ribbon.

There is a tension roller 23*a* to apply tension to the paper 3 conveyed from the print portion 1*a*, and pinch roller 24*a* is arranged opposite of the tension roller 23*a* downstream of print portion 1*a*. Similarly to the print portion 1*a*, there are tension rollers 23*b*, 23*c* to apply tension to the paper 3 conveyed from the print portions 1*b*, 1*c*; and pinch rollers 24*b*, 24*c* are arranged opposite of the tension rollers 23*b*, 23*c* downstream of the print portions 1*b*, 1*c*. These tension rollers 23*a*, 23*b*, 23*c* are driven with predetermined tension by voltage control of a DC motor (not shown in FIG. 7), and the tension of the each of tension rollers 23*a*, 23*b*, 23*c* is switched at the desired timing.

Further, as similarly to the print portions 1*a*, 1*b*, 1*c*; there are the thermal head 9*d*, platen roller 10*d*, overcoat ribbon 11*d*, overcoat ribbon supply roller 12*d* to supply the overcoat ribbon 11*d* to the thermal head 9*d*, and overcoat ribbon take-up roller 13*d* to take up the overcoat ribbon 11*d* at the overcoat portion 1*d*. And downstream of the overcoat portion 1*d*, there are the tension roller 23*d* to apply tension to the paper 3 conveyed from the overcoat portion 1*d*, and pinch roller 24*d* is arranged opposite of the tension roller 23*d*. This tension roller 23*d* is driven with a predetermined tension by voltage control of a DC motor (not shown in FIG. 7), and the tension is switched at desired timing.

The following description is the color printing process for the paper 3 with the above mentioned color printer. In FIG. 8, marks F1, F2, F3, F4 are the thrust tension of each of tension rollers 23*a*, 23*b*, 23*c*, 23*d*; marks W1, W2, W3, W4 are the frictional forces of the print portions 1*a*, 1*b*, 1*c*, and the overcoat portion 1*d*. And in FIG. 8, mark T0 is the tension acting on the feed roller 19; marks T1, T2, T3 are the tension acting on the paper 3 between the tension rollers 23*a*, 23*b*, 23*c* and the thermal heads 9*a*, 9*b*, 9*c* at each print portion 1*a*, 1*b*, 1*c*; and mark T4 is the tension acting on the paper 3 between the tension roller 23*d* and the thermal head 9*d* at the overcoat portion 1*d*.

The following are the equations for the frictional force at each print portion 1*a*, 1*b*, 1*c* and the overcoat portion 1*d*, because the structure is common to each print portion 1*a*, 1*b*, 1*c* and the overcoat portion 1*d;*

$$W1=W2=W3=W4 \tag{4}$$

And these frictional forces W1, W2, W3, W4 have an action-reaction relationship with tensions T1, T2, T3, T4 at each print portions 1*a*, 1*b*, 1*c* and the overcoat portion 1*d*. And these frictional forces W, W2, W3, W4 have same value as tension T1, T2, T3, T4 at each print portion 1*a*, 1*b*, 1*c* and the overcoat portion 1*d*.

First, the front edge of the paper 3 is pulled from the paper roll 2 and conveyed between the feed roller 19 and the pinch roller 20 through the paper guide rollers 17, 18 by a paper feeding mechanism (not shown in FIG. 7 and FIG. 8). At this point, the paper 3 is sandwiched between the feed roller 19 and the pinch roller 20. Then the paper 3 is further conveyed between the tension roller 23*a* and the pinch roller 24*a* through a gap between the thermal head 9*a* and the platen roller 10*a* of the print portion 1*a* by the feed roller 19, which is driven by pulse motor 21 to rotate in accordance with a predetermined conveyance length of the paper 3.

At this point, the thermal head 9*a* is pressed against the platen roller 10*a* via the paper 3, and the pinch roller 24*a* is pressed against the tension roller 23*a* via the paper 3. Then, the tension roller 23*a* is driven by the DC motor with thrust tension F1 to apply a constant tension to the paper 3. Yellow ink ribbon 11*a* is conveyed downstream with the paper 3, in synchronization with the printing speed, and it prints a yellow image on the paper 3 through the thermal head 9*a*. The conveyed yellow ink ribbon 11*a* is taken up by the ink ribbon take-up roller 13*a*.

At the same time, the tension roller 23*a* is driven by larger force than a frictional force at the print portion 1*a*, and by a longer conveyance length than the predetermined conveyance length of the paper 3 at the feed roller 19. But the feed roller 19 acts as a brake to regulate the conveyance length, and makes the conveyance length of the paper 3 constant downstream of the feed roller 19. Therefore, the paper 3 between the tension roller 23*a* and the thermal head 9*a* is subject to a tension T1, which has the same value as the frictional force W1 at the print portion 1*a*. And the feed roller 19 is subject to a tension due to the difference between thrust tension F1 and tension T1. In the other words, as shown in FIG. 9, at time 1 for printing yellow on a first portion of the paper, the thrust tension F1 of the tension roller 23*a* is set to $T+\alpha T$, then tension T1 acting on the paper 3 between the tension roller 23*a* and the thermal head 9*a* is set to T, and tension T0 acting on the feed roller 19 is set to $\alpha T$. Furthermore, each of the thrust tensions F2, F3, F4 are set to zero, because the tension rollers 23*b*, 23*c*, 23*d* are not active.

After printing of the yellow image is completed, the front edge of the paper 3 is conveyed between the tension roller 23*b* and the pinch roller 23*b* through the gap between the thermal head 9*b* and the platen roller 10*b* of the print portion 1*b*. At this point, the thermal head 9*b* is pressed against the platen roller 10*b* through the paper 3, and the pinch roller 24*b* is pressed against the tension roller 23*b* through the paper 3. Then, the tension roller 23*b* is driven by the DC motor with thrust tension F2 to apply constant tension to the paper 3. Magenta ink ribbon 11*b* is conveyed downstream with the paper 3 in synchronization with the printing speed, and prints a magenta image on the paper 3 with the thermal head 9*b*. The conveyed magenta ink ribbon 11*b* is taken up by the ink ribbon take-up roller 13*b*.

At the same time of the magenta image printing for a first portion of the paper by the thermal head 9*b*, a yellow image is printed on a second portion of the paper by the thermal head 9*a*. In the same manner as for the yellow image, the tension roller 23*b* is driven by a larger force than the frictional force at the print portion 1*b*, and so as to provide a longer conveyance length than the predetermined conveyance length of the paper 3 at the feed roller 19. This means that the thrust tension F2 of the tension roller 23*b* is switched from zero to T+αT, and the thrust tension F1 of the tension roller 23*a* is switched from T+αT to T, and the tension roller 23*a* is driven.

At this time, there is a balance between the thrust tension F1 and the frictional force W1 at the print portion 1*a*. As a result, the a first portion of the paper 3 between the tension roller 23*b* and the thermal head 9*b* is subject to a tension T2, which has the same value as the frictional force W2 at the print portion 1*b*. The feed roller 19 receives the tension due to the difference between thrust tension F2 and tension T2 through the print portion 1*a*. As shown in FIG. 7, at the time 2 for printing magenta on a first portion of the paper, the thrust tension F1 of the tension roller 23*a* is switched from T+αT to T, and the thrust tension F2 of the tension roller 23*b* is switched from zero to T+αT. Then, the tension T1 acting on a second portion of the paper 3 between the tension roller 23*a* and the thermal head 9*a* is set to T, the tension T2 acting on a first portion of the paper 3 between the tension roller 23*b* and the thermal head 9*b* is also set to T, and the tension T0 acting on the feed roller 19 is set to αT. Furthermore, each of thrust tensions F3 and F4 are set to zero, because the tension rollers 23*c*, 23*d* are not active.

After printing of the magenta image is completed, the front edge of the paper 3 is conveyed between the tension roller 23*c* and the pinch roller 23*c* through the gap between the thermal head 9*c* and the platen roller 10*c* of the print portion 1*c*. At this point, the thermal head 9*c* is pressed against the platen roller 10*c* sandwiching the paper 3, and the pinch roller 24*c* is pressed against the tension roller 23*c* sandwiching the paper 3. Then, the tension roller 23*c* is driven by the DC motor with thrust tension F3 to apply constant tension to the paper 3. And cyan ink ribbon 11*c* is conveyed downstream with the paper 3 in synchronization with the printing speed, and it prints a cyan image on the paper 3 through the thermal head 9*c*. The conveyed cyan ink ribbon 11*c* is taken up by the ink ribbon take-up roller 13*c*.

At the same time of the cyan image printing for the a first portion of the paper by the thermal head 9*c*, a magenta image is printed on a second portion of the paper by the thermal head 9*b*, and a yellow image is printed on a third portion of the paper by the thermal head 9*a*. In the same manner as for the magenta image, the tension roller 23*c* is driven by larger force than the frictional force at the print portion 1*c*, and so as to provide a longer conveyance length than the predetermined conveyance length of the paper 3 at the feed roller 19. This means that the thrust tension F3 of the tension roller 23*c* is switched from zero to T+αT, and the thrust tension F2 of the tension roller 23*b* is switched from T+αT to T, the thrust tension F1 of the tension roller 23*a* is maintained at T, and the tension rollers 23*a*, 23*b* are driven.

As the same process is working at time 3 as that for times 1 and 2, at the time 3 for printing cyan on a first portion of the paper, the thrust tension F1 of the tension roller 23*a* is maintained at T, the thrust tension F2 of the tension roller 23*b* is switched from T+αT to T, and the thrust tension F3 of the tension roller 23*c* is switched from zero to T+αT. Then, respective tensions T1, T2, T3 acting on a second portion of the paper 3 between the tension rollers 23*a*, 23*b*, 23*c* and the thermal heads 9*a*, 9*b*, 9*c* are set to T. and the tension T0 acting on the feed roller 19 is set to αT. Furthermore, the thrust tension F4 is set to zero, because the tension roller 23*d* is not active.

After the printing of the cyan image is completed, the front edge of the paper 3 is conveyed between the tension roller 23*d* and the pinch roller 23*d* through the gap between the thermal head 9*d* and the platen roller 10*d* of the print portion 1*d*. At this point, the thermal head 9*d* is pressed against the platen roller 10*d* sandwiching the paper 3, and the pinch roller 24*d* is pressed against the tension roller 23*d* sandwiching the paper 3. Then, the tension roller 23*d* is driven by the DC motor with a thrust tension F4 to apply a constant tension to the paper 3, and overcoat ribbon lid is conveyed downstream with the paper 3 in synchronization with the printing speed, and it overcoat-prints with the thermal head 9*d* on the paper 3 having printed thereon overlapping yellow, magenta, and cyan images. The conveyed overcoat ribbon lid is taken up by overcoat ribbon take-up roller 13*d*.

At the same time overcoat printing is carried out for the first portion of the paper by the thermal head 9*d*, a cyan image is printed on a second portion of the paper by the thermal head 9*c*, a magenta image is printed on a third portion of the paper by the thermal head 9*b*, and a yellow image is printed on a fourth portion of the paper by the thermal head 9*a*. In the same manner as for the cyan image, the tension roller 23*d* is driven by a larger force than the frictional force at the overcoat portion 1*d*, and so as to provide a longer conveyance length than the predetermined conveyance length of the paper 3 at the feed roller 19. This means that the thrust tension F4 of the tension roller 23*d* is switched from zero to T+αT, and the thrust tension F3 of the tension roller 23*c* is switched from T+αT to T. the thrust tensions F1 and F2 of the tension rollers 23*a*, 23*b* are maintained at T, and the tension rollers 23*a*, 23*b*, 23*c* are driven.

As the same process is working at time 4 as that at times 1,2 and 3, at the time 4 for overcoat printing of a first portion of the paper, the respective thrust tensions F1 and F2 of the tension rollers 23*a*, 23*b* are maintained at T, thrust tension F3 of the tension roller 23*c* is switched from T+αT to T, and thrust tension F4 of the tension roller 23*d* is switched from zero to T+αT. Then, the respective tensions T1, T2, T3, T4 acting a second portion of the paper 3 between the tension rollers 23*a*, 23*b*, 23*c*, 23*d* and the thermal heads 9*a*, 9*b*, 9*c*, 9*d* are set to T, and tension T0 acting on the feed roller 19 is set αT. reaches After the overcoat printing is over, the front edge of a first portion of the paper 3 reaches the cutter 8 through the gap of the paper discharging roller 6 and the pinch roller 7. Finally, the cutter 8 cuts a first portion of the paper, which has been printed with yellow, magenta, and cyan images and overcoat printed, and holder 22 holds the first portion of the paper. After the above mentioned process is over, the printing of the paper is finished.

According to embodiment 1 for a color printer and a method of paper feeding, the tension acting on the paper 3 at the each of print portions 1*a*, 1*b*, 1*c*, and the overcoat portion 1*d* is switched each time the front edge of the paper 3 is conveyed to each print portion 1*a*, 1*b*, 1*c*, and the overcoat portion 1*d*. So, tensions T1, T2, T3, T4 acting on the paper 3 located between the tension rollers 23*a*, 23*b*, 23*c*, 23*d* and the thermal heads 9*a*, 9*b*, 9*c*, 9*d* remain constant within limited rage of acceptance; and also, tension T0 acting on the feed roller 19 remains at a constant value $\alpha T$, wherever the paper 3 is located.

The prevention expansion and contraction of paper 3 prevents shear of the colors during printing of each color's dots at each print portion 1*a*, 1*b*, 1*c*. The prevention changes of tension acting on the feed roller 19 prevents shear of the colors by uneven conveyance lengths of the paper 3. As the result, it is possible to maintain a predetermined accuracy of printing of each color's dots even in the beginning of printing, and it is not necessary to throw away the first three papers 3, which reduces waste.

According to embodiment 1 for a color printer and method of paper feeding, the overcoat portion 1*d* is added to the print portions 1*a*, 1*b*, 1*c* to overcoat the paper 3 after each color image is printed. The prevention of shear of the colors in printing and overcoating can be achieved by maintaining a constant tension acting on the paper 3 at the overcoat portion 1*d* and tension acting on the paper 3 at the print portions 1*a*, 1*b*, 1*c*, when the front edge of paper is conveyed to the overcoat portion 1*d*.

The embodiment 1 shows the construction of a color printer having an overcoat portion 1*d* downstream of the print portions 1*a*, 1*b*, 1*c*, color printers having the print portions 1*a*, 1*b*, 1*c* without the overcoat portion 1*d* are also known to those skilled in the art. And also, the embodiment 1 shows the construction of a color printer having printed yellow, magenta, and cyan image overlapping on the paper 3, color printers having two color images overlapping on the paper 3, or four or more over color images overlapping on the paper 3 are also known to those skilled in the art.

The embodiment 1 also shows the construction of a color printer applying tension to the paper 3 by the tension rollers 23*a*, 23*b*, 23*c*, 23*d*, color printers having tension applied to portions at the print portions 1*a*, 1*b*, 1*c* and the overcoat portion 1*d* respectively to apply tension to the paper 3 are also known.

It is noted that the embodiment 1 shows a color printer using ink ribbons but color printers using thermal color development methods without ink ribbons may bring the same advantages as those of the color printer using ink ribbons. It is also noted that the embodiment 1 shows a color printer which switches the tension acting on the paper by the tension rollers, when the recording paper is conveyed to print portions 1*a*, 1*b*, 1*c* and the overcoat portion 1*d*. This makes tension acting on the paper conveyed to the print portion be maintained within a limited range, wherever the front edge of the paper located. And also, it maintains constant the tension acting on the feed roller. This prevents the shear of the colors in printing caused by expansion and contraction of the paper and changes of the conveyance length of the paper.

Embodiment 2

In the case of a color printer using the thermal transfer method or the thermal color development method, the frictional coefficient between an exothermic portion of a thermal head and a paper or ink ribbon fluctuates depending on the energy acting on the exothermic portion and the quantity of heat stored in the thermal head. These fluctuation occurs with the each line of printing, and on a millisecond order timescale. Tension control according to embodiment 1 may be able to prevent the lateral print shading on recording the paper 3. However, customers require more precise paper feeding, and it is difficult to control tension fluctuations on a millisecond order by tension control applying the above-mentioned embodiment 1, and tension fluctuations on the millisecond order cause lateral print shading on the recording paper 3, which decreases the quality of printing.

The object of the second embodiment of a color printer is to provide a paper feeding mechanism which can prevent tension fluctuations on the millisecond order by balancing the tension fluctuations sensed by a load cell and the tension produced by a DC motor to chive the tension rollers 23*a*, 23*b*, 23*c*. The tension fluctuations between the exothermic portion of the thermal head and the paper or the ink ribbon occurs at each line of printing. Furthermore, the second embodiment of a color printer may provide fine quality of printing without lateral print shading.

Figure 10:
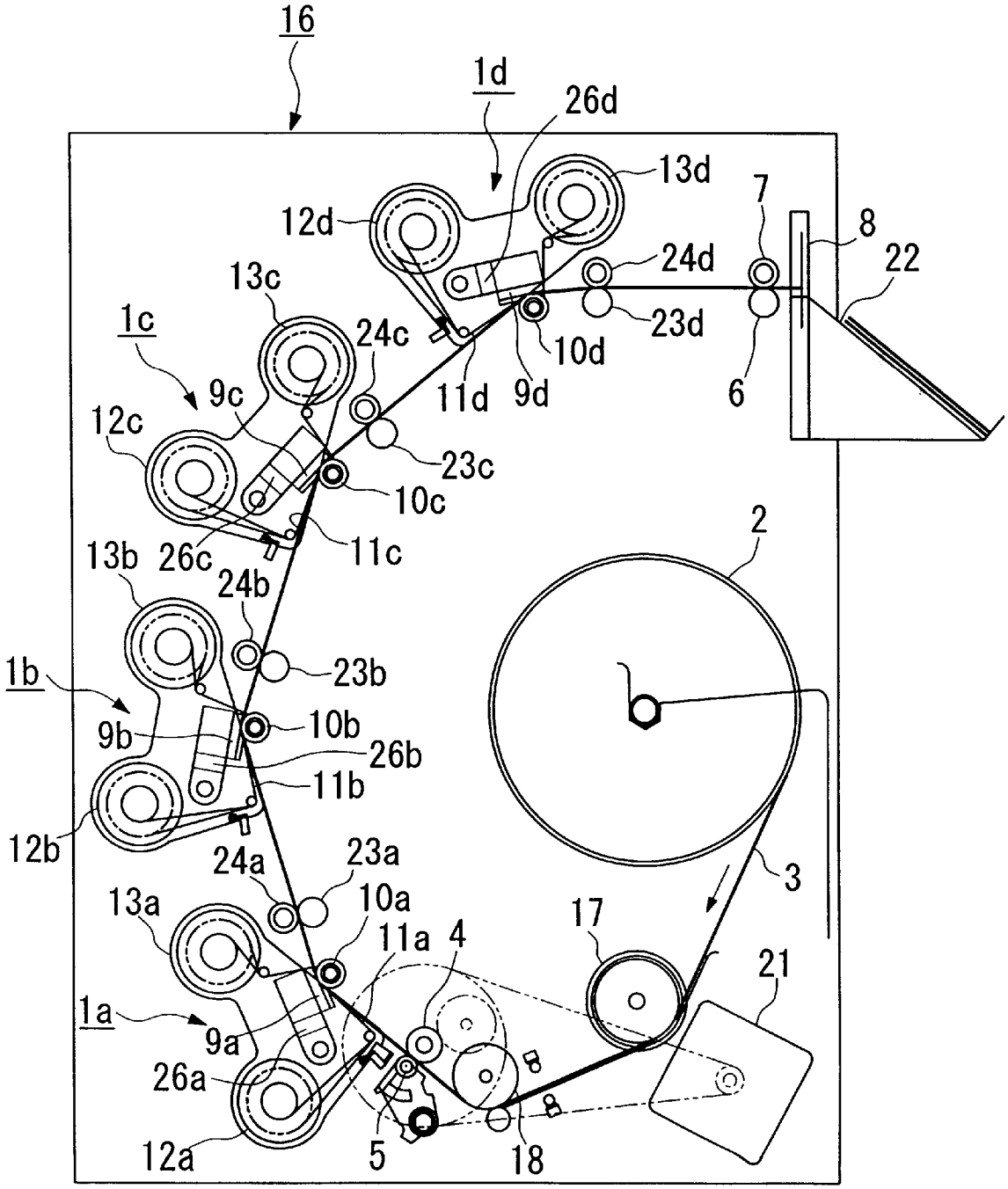
FIG. 10 is a constitutional diagram of the second embodiment of a color printer of the present invention.
Figure 11:
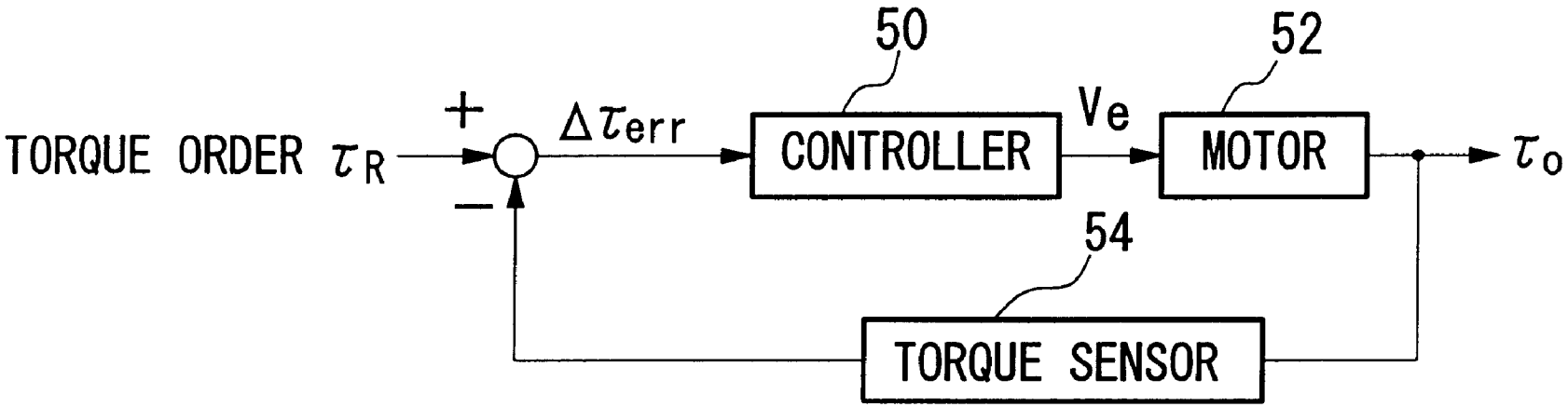
FIG. 11 is a constitutional block diagram of tension control.

FIG. 10 is a constitutional diagram of the second embodiment of this invention of a color printer. According to FIG. 10, load cells 26*a*, 26*b*, 26*c*, 26*d* to detect the frictional force at the thermal heads are provided, as shown in FIG. 7. Each load cell 26*a*, 26*b*, 26*c*, 26*d* respectively detects the frictional force W1, W2, W3 at the print portions 1*a*, 1*b*, 1*c* and the frictional force W4 at the overcoat portion 1*d* as shown in FIG. 8. The thrust tension F1, F2, F3 at the tension rollers 23*a*, 23*b*, 23*c* are controlled to be coincident with the frictional forces W1, W2, W3 by controller 50, which is shown in FIG. 11. The thrust tension F4 at the tension roller 23*d* is set to tension $T+\alpha T$ as shown in FIG. 9, because the tension roller 23*d* is the front roller.

FIG. 11 shows a constitutional block diagram of the tension control. Torque order $\tau R$ is a voltage value of a DC motor, which is coincident with the frictional forces at the thermal heads previously estimated. Controller 50 determines the voltage Ve supplied to the DC motor 52 in accordance with difference $\Delta\ \tau err$ between the torque order $\tau R$ and feedback value from a torque sensor 54. The DC motor 52 applies tension $\tau$0 to the paper 3 by the tension rollers 23*a*, 23*b*. 23*c* with a force corresponding to supply voltage Ve. The control cycle for the tension control is set to the order of milliseconds or several hundreds of microseconds.

The following are the factors determining the frictional forces at the thermal heads.

(i) The pressing force at the thermal heads.

(ii) The supplied energy per a line to print (iii) The temperature of the thermal heads of thermal printing.

(iv) The estimated energy stored in the thermal heads and the paper contacting portion.

The second embodiment provides a color printer using the thermal transfer method or thermal color development method with fine quality of printing without lateral print shading, by controlling the tension. The first control of tension is carried out to make the tension correspond to the frictional force on the paper at recording portion by applying a tension to the paper excess of the frictional force of the paper at the print portion, when the front edge of the first portion of the paper reaches the first print portion. The second control of tension is carried out the feed roller to balance the frictional force by motor driving force control portion.

Embodiment 3—Thermal Head

Figure 12:
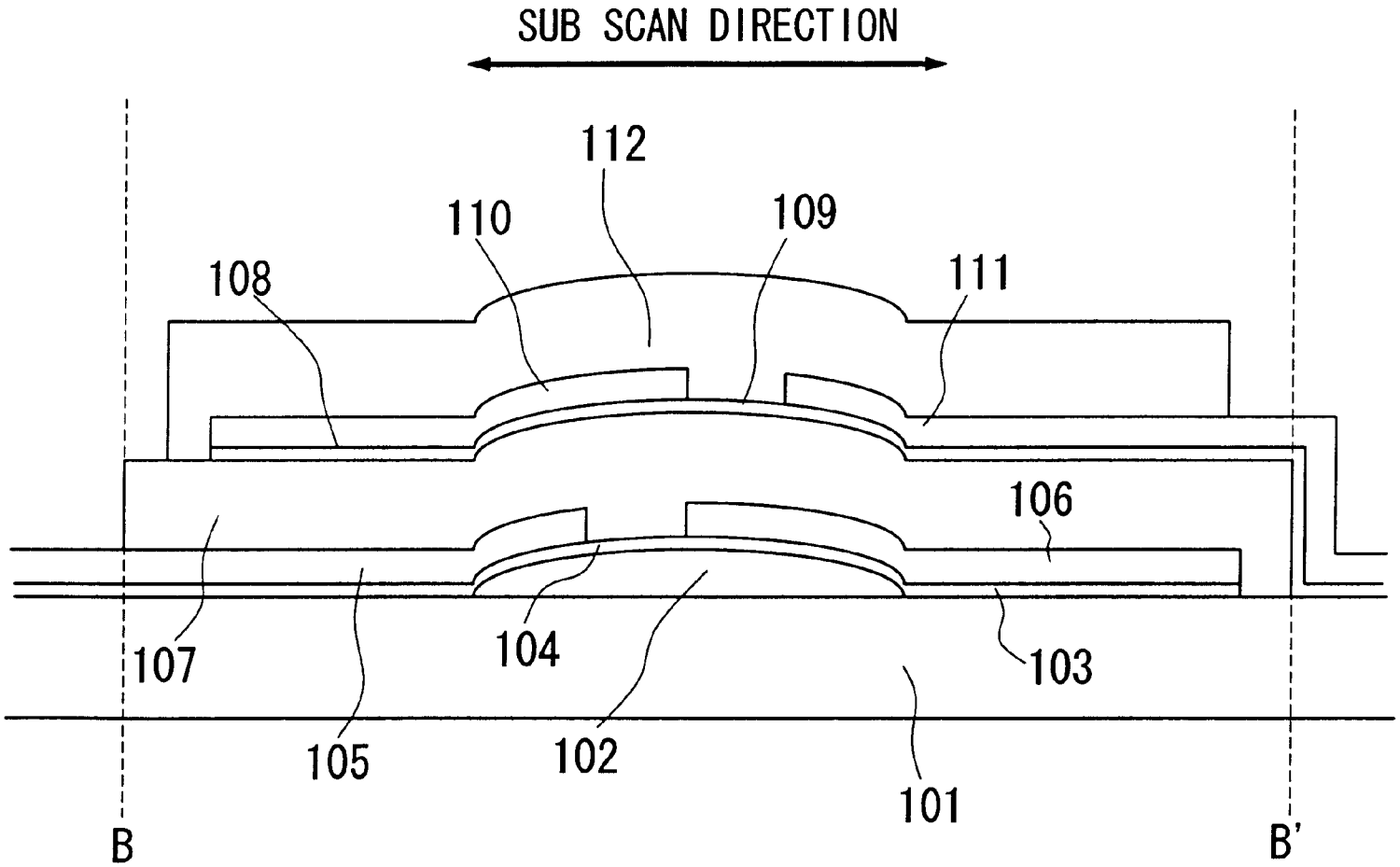
FIG. 12 shows a thermal head in a section view of the third, fourth, and fifth embodiments of this invention.
Figure 13:
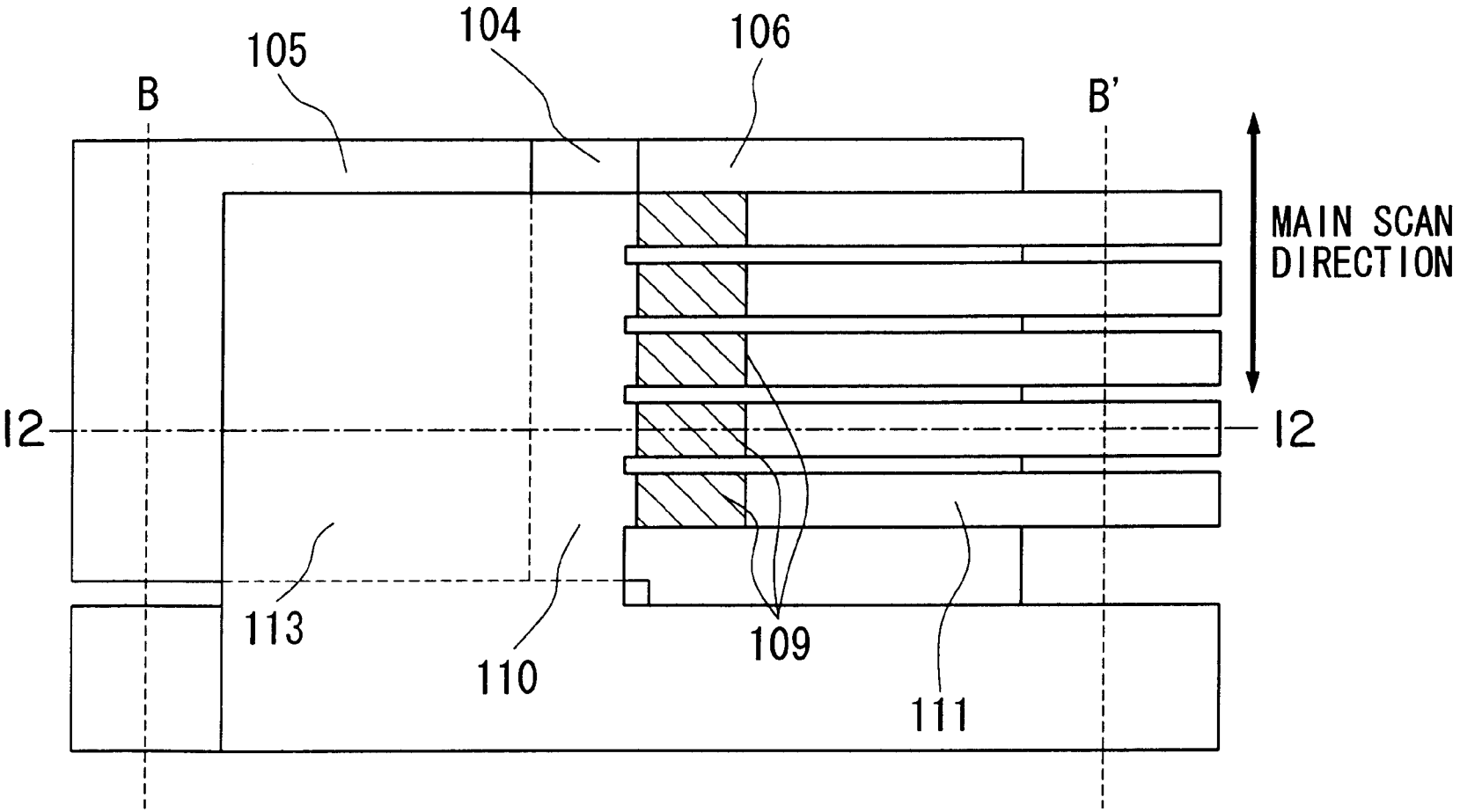
FIG. 13 shows a thermal head in plane view of the third embodiment of this invention.

FIG. 12 and FIG. 13 are constitutional diagrams of the third embodiment of this invention. In the third embodiment, FIG. 12 shows a sectional view of the thermal head at the 12—12 line illustrated in FIG. 13.

In FIG. 12, the material of base 101 is an insulating ceramic, and alumina is commonly used as the insulation ceramic. The surface of the base 101 is polished if necessary. A partial glass glaze is formed upon the base 101 by baking at a temperature from 1000 to 1300 degrees centigrade after the process of screen printing of glass paste and drying are executed one time or repeated several times. The base 101 and partial glass glaze 102 form a ceramic substrate. However, general-purpose ceramic substrates which can be used for this embodiment, such as a substrate formed from pure alumina, or a substrate formed from etched glass glaze on an alumina base are known to those skilled in the art.

After the ceramic substrate is formed, a first layer of an electric circuit pattern is formed upon the ceramic substrate by the following process. First, a resistance film 103 is formed by sputtering of $TaSiO_2$, for example; and patterned by photolithography and etching. The resistance film 103 has a dot pattern, and similar to the exothermic portion 109 shown in FIG. 13, and the dots are entirely or partially connected to each other in the same way as in exothermic portion 104. Other materials for the resistance film 103 are also available, such as $NbSiO_2$, NiCr, NiCrSi, and so on. Other methods of forming the resistance film 103 are also known to those skilled in art, such as vacuum evaporation, CVD (Chemical Vapor Deposition), ion plating, and so on. Other methods of patterning the resistance film 103 is also available, such as wet etching, chemical dry etching, and so on.

In the next process, electrode films 105, 106 are formed by sputtering of aluminum alloy, and patterned by photolithography and etching. The pattern of the electrode film 105, 106 is not only divided into dot as for the electrode film 111 as shown in FIG. 13, but the dots are also interconnected entirely or partially. The exothermic portion 104 is an exposed part located between the electrode film 105 and the electrode film 106 of resistance body. The length of the exothermic portion 104 can be different from the length of the exothermic portion 109. But other materials for the electrode film are also known to be available to those skilled in the art, such as Cu, Au, W. Mo, and their alloys. The method of forming the electrode film and the method of patterning the electrode film are similar to that of the resistance film 103. The electrode film 106 is shaped like the character "II" at the both sides of the thermal head, and the electrode film 106 is extended in the same direction as the electrode film 105.

The third process is forming the insulator layer 107 by sputtering of $SiO_2$ to 8 $\mu$m thickness within the range between line B and line B', for example. The right edge of the electrode film 106 is located to the left side of the line B', and there is electrical insulation between the first layer from the second layer. The electrode film 105 and the electrode film 106 are connected with flexible electrodes or terminals at the extended portion (not shown in FIG. 13). The insulator layer 107 electrically insulates the first layer from the second layer of the electric circuit pattern. Other materials for the insulator layer 107 are also known to be available to those skilled in the art, such as $Ta_2O_5$, SiC, SiAlON, SiN, DLC (Diamond Like Carbon), BN, $BO_2$, $TiO_2$, TiN, and their chemical compounds and mixtures of them. The method of forming the insulator layer 107 and the method of patterning the insulator layer 107 are similar to that of the resistance film 103.

The insulator layer 107 conducts heat generated at the exothermic portion 104 to surface of the thermal head, so the materials of the insulator layer 107 have high thermal conductivity and the thickness of the insulator layer 107 is made as small as possible while providing insulation. The insulator layer 107 can be formed of plural layers with two or more materials. The insulator layer 107 has bump at its surface corresponding to the thickness of the electrode films 105, 106. Therefore, surface of the insulator layer 107 should be polished to eliminate this bump.

The fourth process is the formation of a second layer of the electric circuit pattern upon the insulator layer 107 by the following procedure. First, resistance film 108 is formed by sputtering of $TaSiO_2$, for example, and patterned by photolithography and etching. The pattern of the resistance film 108 is a divided dot pattern as shown in FIG. 13. The left edge of the resistance film 108 is located to the right side of the line B, and there is electrical insulation between the first layer and the second layer. However, those skilled in the art know that the materials, and methods of forming and patterning the resistance film are not limited those mentioned above, and that a procedure similar to that of the resistance film 103 at the first layer can also be used.

In the next procedure, electrode film 110, 111 is formed by sputtering of aluminum alloy, and patterned by photolithography and etching. The pattern of the electrode film 110, 111 is divided into dots to coincide with the resistance film 108. The exothermic portion 109 is an exposed part located between the electrode film 110 and the electrode film 111 of the resistance body. The exothermic portion 109 is shifted in the sub scan direction as shown in FIG. 13, so that the left edge of exothermic portion 109 is placed just on the right edge of exothermic portion 104. However, it is known to those skilled in art that the layout of the exothermic portion 109 and exothermic portion 104 is not limited the above-mentioned layout, and that the layout can have complete, partial, or no overlap of the exothermic portion 109 and exothermic portion 104. The exothermic portion 109 can freely shift back and forth in the sub scan direction as shown in FIG. 12. Those skilled in art know that the materials, and methods of forming and patterning of the electrode film 110, 111 are not limited to those mentioned above, but can also be similar to those of the resistance film 103 of the first layer.

It is preferable that the second layer of the electrode film have the characteristic of high thermal conductivity and strong heat-resistance, because the heat generated at the first layer of the electrode film is transmitted to the surface of the thermal head though the second layer of the electrode film 110. The left side of the extension part of the electrode film 110 is connected to the resistance film 108, and the electrode film 110 forms common electrode film 113. The left edge of common electrode film 113 is located to the right side of line B, and there is electrical insulation between the first layer and the second layer. The common electrode film 113 is connected with flexible electrodes or terminals at the extended portion (not shown in FIG. 13). The electrode film 111 is connected with control IC (not shown in FIG. 13) by wire bonding.

In the final procedure, protection film 112 is formed by sputtering of SiAlON to a 5 $\mu$m thickness, for example. But those skilled in art know that the materials, method of forming, and thickness of the protection film 112 are not limited to those mentioned above, but can also be similar to those of the insulator layer. There is also possible to use plural layers with plural materials to form the protection film 112. It is preferable to eliminate bump by polishing the surface of the protection film 112.

The following description is the control method of the thermal head in the third embodiment. The control IC (not shown in FIG. 13) of the thermal head makes the exothermic portion 104 generate heat corresponding to the bias energy, and it makes the exothermic portion 109 generate heat to carry out dot gradation printing. This control procedure is executed during throughout the printing procedure with paper conveying. This control procedure is described in detail in Japanese Unexamined Patent Publication, First Publication Nos. H10-138541 and H10-138547 which were filed by the present applicant.

Embodiment 4—Thermal Head

Figure 14:
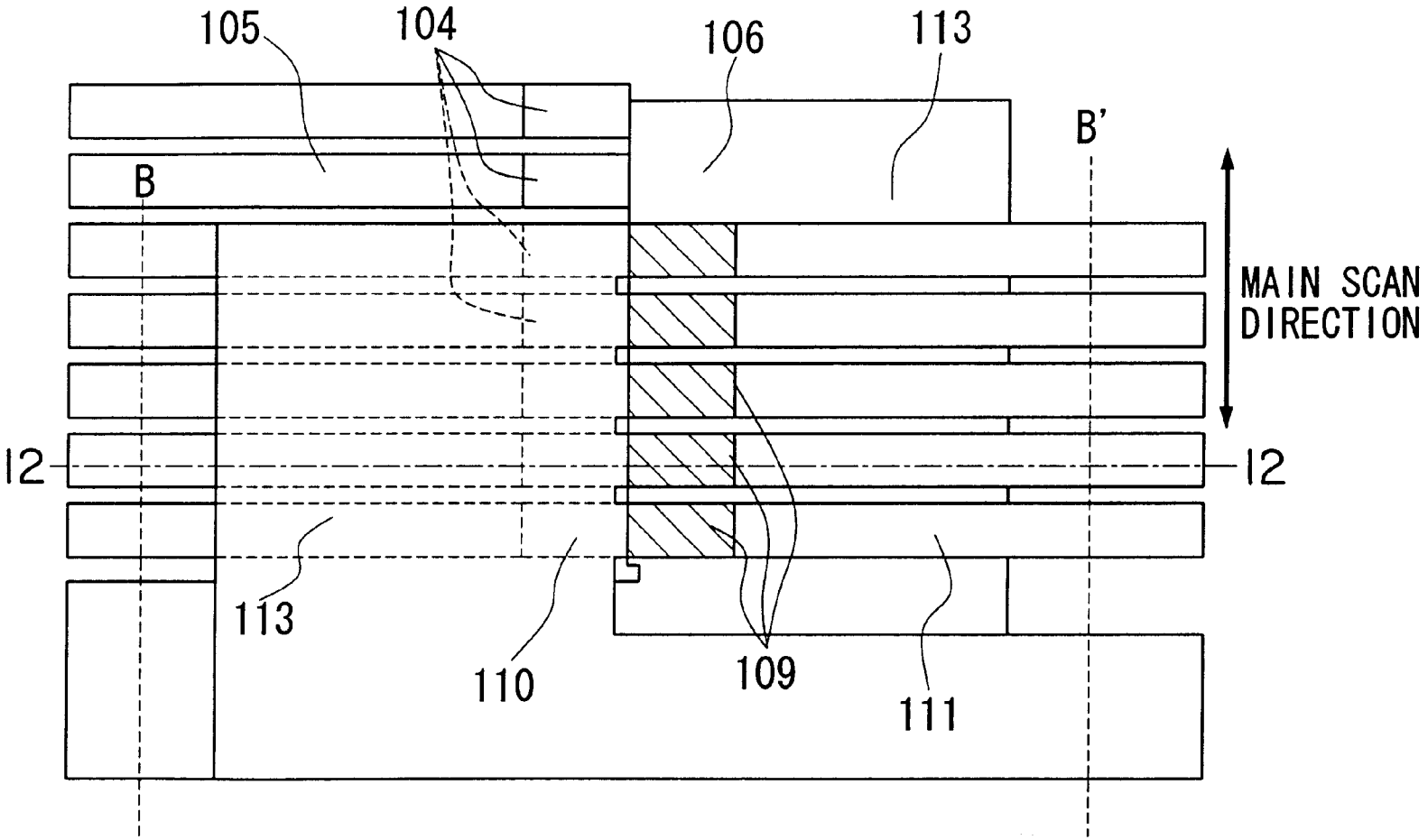
FIG. 14 shows a thermal head in plane view of the fourth embodiment of this invention.

FIG. 12 and FIG. 14 are constitutional diagrams of the fourth embodiment of this invention. In the fourth embodiment, FIG. 12 shows a sectional view of the thermal head at the 12—12 line illustrated in FIG. 14. The fourth embodiment is different from the third embodiment in the point that the patterns of the first layer of the resistance film and the electrode film divided dots. Otherwise, the constitution of the fourth embodiment is the same as that of the third embodiment. For example, the exothermic portion 109 is shifted in the sub scan direction as shown in FIG. 14, so that the left edge of the exothermic portion 109 is placed just on the right edge of exothermic portion 104. But those skilled in the art know that the layout of exothermic portion 109 and exothermic portion 104 is not limited to the above-mentioned layout, and that the layout can have complete, partial, or no overlap of the exothermic portion 109 and the exothermic portion 104. The exothermic portion 109 can freely shift back and forth in the sub scan direction as shown in FIG. 12.

The following describes the control method of the thermal head of the fourth embodiment. Control IC (not shown in FIG. 14) of the thermal head makes the exothermic portion 104 and the exothermic portion 109 generate heat at the same time, which provides lines of dot gradation printing at the same time. For the sublimation method, the control IC controls the paper and the ink ribbon for two line printing. In case of self-color development method, the control IC controls the paper for two line printing. The control IC makes these process repeat until all the printing is completed (see Japanese Unexamined Patent Publication, First Publication No. H01-058566).

Figure 15:
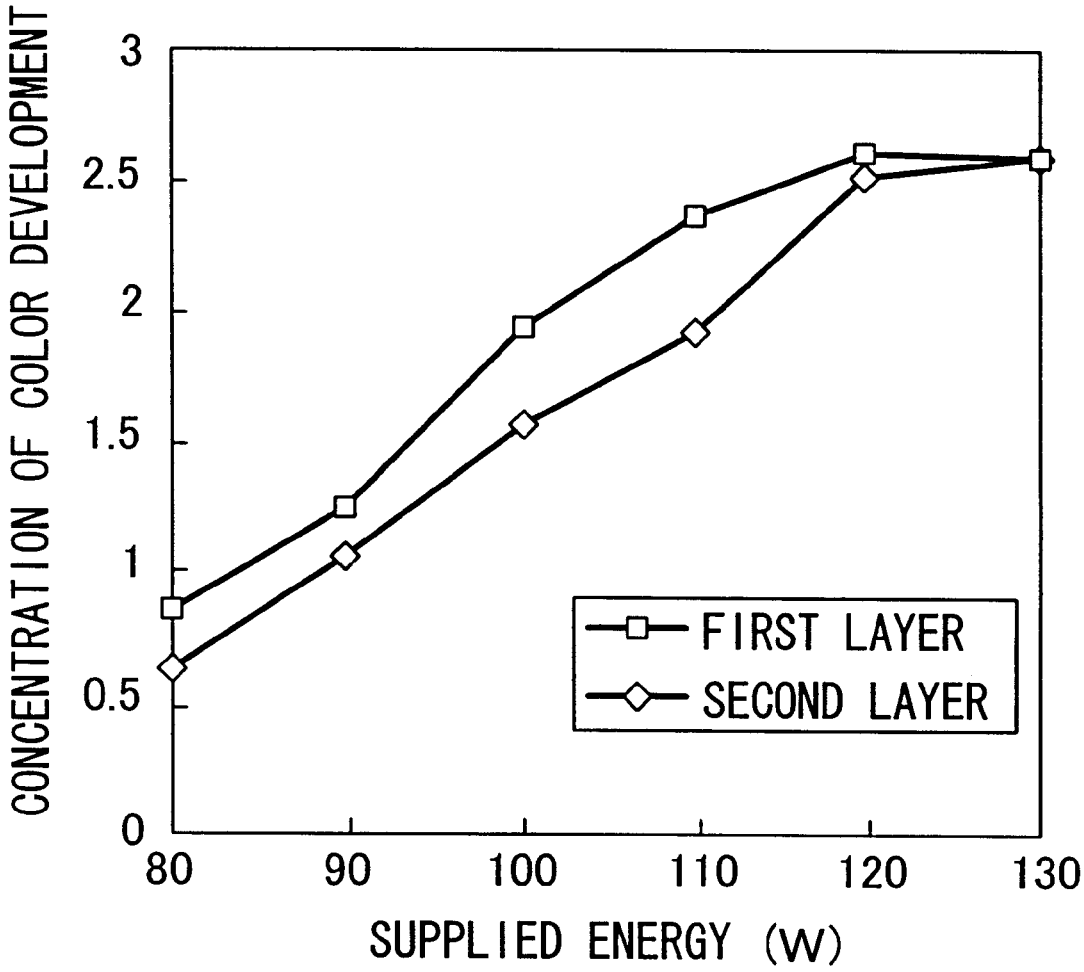
FIG. 15 illustrates the relation between the supplied energy and the concentration of color development for the thermal head of the fourth embodiment.

FIG. 15 illustrates the relationship between the supplied energy and the concentration of color development for the thermal head of the fourth embodiment. In this graph. the paper and the ink ribbon (cyan) for the sublimation method arc used, and the results of prints by the first layer and the second layer are shown. In this graph, using a single layer of heat-generation by the first layer or the second layer executes color printing.

When printing with the first layer, the heat generated at the exothermic portion 104 is transmitted to the surface of the thermal head through the insulator layer 107, the second layer of the resistance film 108, the electrode film 110 and the protection film 112. On the other hand, when printing with the second layer, the heat generated at the exothermic portion 109 is transmitted to the surface of the thermal head through the protective film 112. Therefore, one skilled in the art might suppose that printing by the first layer requires an extra amount of energy compared with printing by the second layer. But the actual increase in energy at the exothermic portion 104 is less than 10% of the heat generated at the exothermic portion 109, as shown in FIG. 15. In the case of simultaneous two line printing by the first layer and the second layer, the increase in energy supplied to the first layer is less than 10% of the heat generated at the exothermic portion 109.

Embodiment 5—Thermal Head

Figure 16:
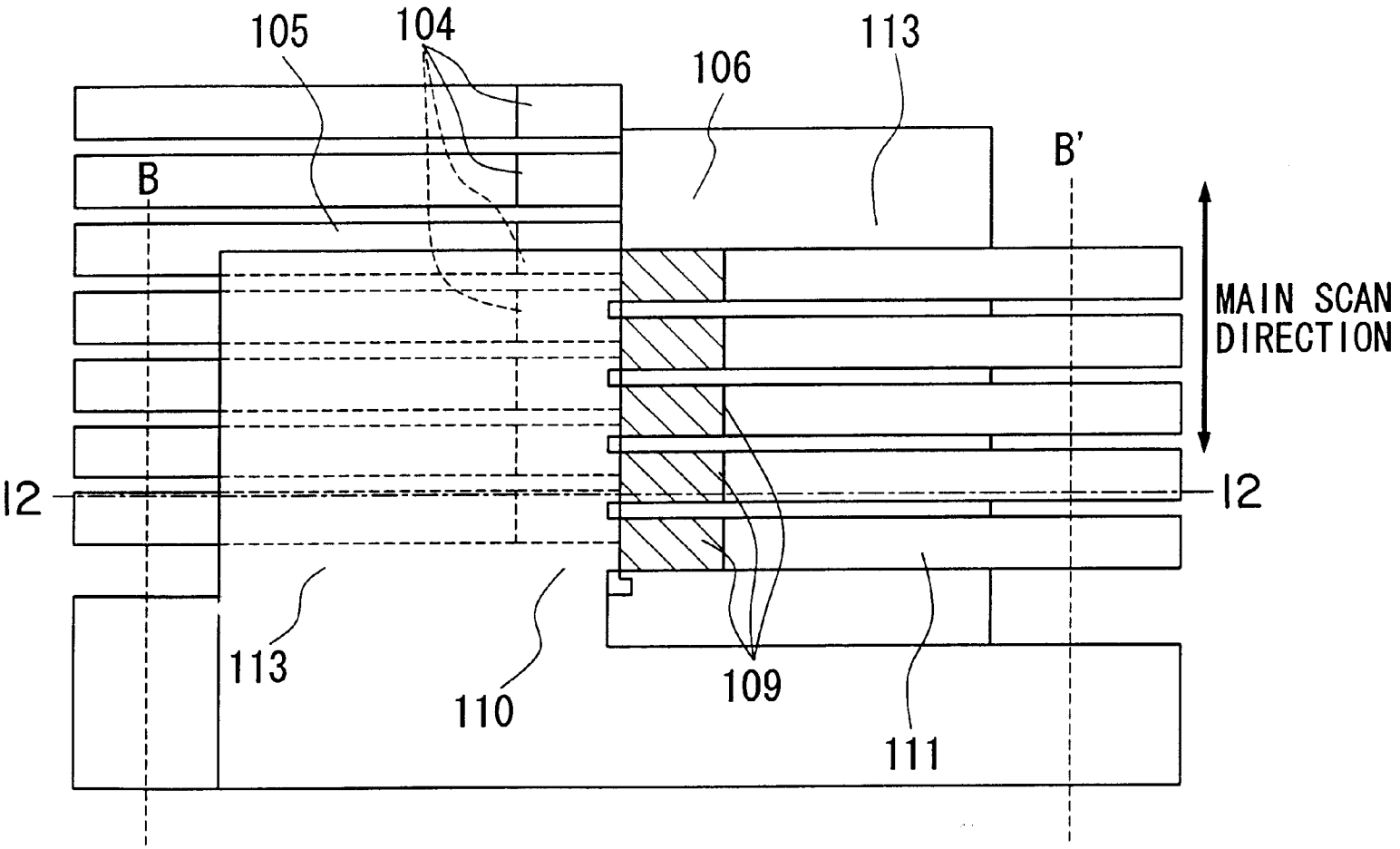
FIG. 16 shows a thermal head in plane view of the fifth embodiment of this invention.

FIG. 12 and FIG. 16 are constitutional diagrams of the fifth embodiment of this invention. For the fifth embodiment, FIG. 12 shows section view of the thermal head at the 12—12 line illustrated in FIG. 16. The fifth embodiment is different from the third embodiment in the point that the pattern of the first layer of the resistance film and the electrode film divided dots. The fifth embodiment is also different from the fourth embodiment in the point that the layout of the exothermic portion 104 and the exothermic portion 109 is shifted by a half dot in the main scan direction. However, those skilled in the art know that the layout of exothermic portion 109 and exothermic portion 104 is not limited to the above mentioned layout, and can also be shifted from zero dots to any number of dots.

Otherwise, the constitution of the fifth embodiment is the same as that of the third embodiment. For example, the exothermic portion 109 is shifted in the sub scan direction as shown in FIG. 16, so that the left edge of the exothermic portion 109 is placed just on the right edge of exothermic portion 104. But those skilled in the art know that the layout of exothermic portion 109 and exothermic portion 104 is not limited to the above mentioned layout, but can also have complete, partial, or no overlap of the exothermic portion 109 and the exothermic portion 104. The exothermic portion 109 can freely shift back and forth in the sub scan direction as shown in FIG. 12.

The following describes the control method of the thermal head of the fifth embodiment. Control IC (not shown in FIG. 14) of the thermal head makes the exothermic portion 104 and the exothermic portion 109 generate heat at the same time, producing two lines of dot gradation printing at the same time. It should be noted that the energy supplied to the first layer is increased a little compared with that of second layer, and compared with that of the fourth embodiment. In the sublimation method, the control IC controls the paper and the ink ribbon for two line printing. In case of self-color development method, the control IC controls the paper for two lines printing. The control IC makes these process repeat until the printing is completed (see Japanese Unexamined Patent Publication, First Publication No. H10-138547). The conveyance length of the paper is able to adjust from 0.5 dot length to 2 dot length to conform with the layout of exothermic portion 104 and exothermic portion 109.

According to above mentioned third, fourth, and fifth embodiments, generally used ceramic substrates are suitable for the double-line thermal heads and the preheat thermal head, and these provide stable print quality. There is no need to use a stainless substrate or a metal common electrode in the thermal head, and no problem occurs due to differences of thermal expansion coefficients between a metal and glass glaze or alumina substrate. This thermal head is easily manufactured at low cost, because it is made in a way by similar to the conventional process.

Another merit of these embodiments is high density printing between the two lines without openings, because there is no common electrode between the two lines of the resistance exothermic portion. It should be noted that conventional double-line thermal heads have a common electrode between the two lines of the resistance exothermic portion. The third merit of these embodiments is that there is no heat loss between the resistance exothermic portion of first line and that of the second line, because there is no common electrode between the two lines of the resistance exothermic portion. It should be noted that conventional preheat thermal heads have a common electrode between the two line of the resistance exothermic portion. The fourth merit of these embodiments is that the layout can be freely made without restrictions between the exothermic portion of the first layer of an electric circuit pattern and the exothermic portion of the second layer of the electric circuit pattern. The reason for this is that the heat generated at the first layer of an electric circuit pattern is transmitted to the surface of the thermal head through the insulator layer formed on the first layer of an electric circuit pattern and the second layer of the electric circuit pattern.

Embodiment 6—Lamp

Figure 17:
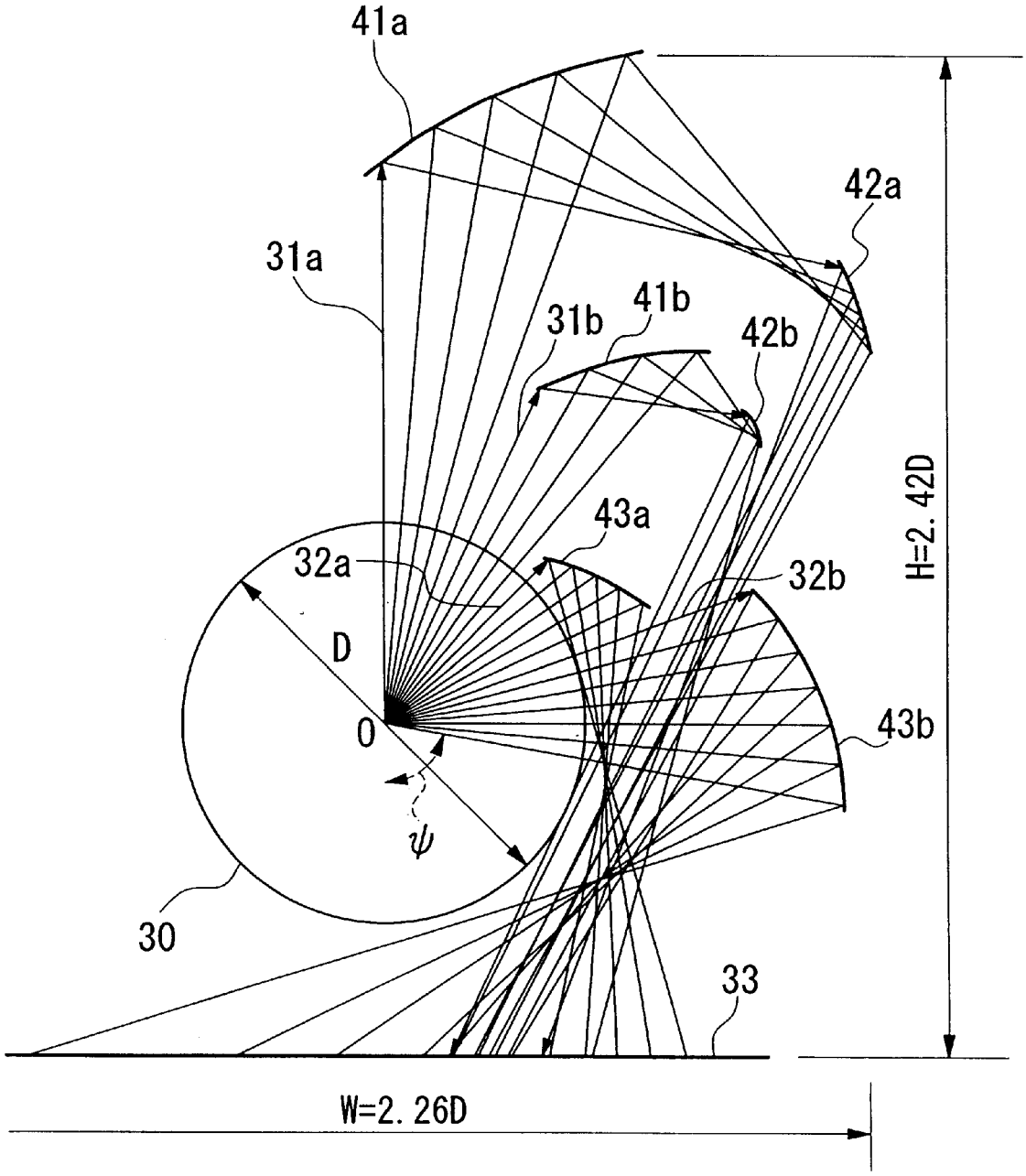
FIG. 17 is a constitutional diagram of a lamp reflex board of the sixth embodiment of this invention.

FIG. 17 is a constitutional diagram of the sixth embodiment of this invention, a lamp reflex board, and illustrates only one side because the lamp reflex board is symmetric. In FIG. 17, rear reflect boards 41*a*, 41*b* are located at the rear of lamp 30, and they reflex light 31*a*, 31*b* radiated from the rear-side of lamp 30 to the side of lamp 30. Rear-side reflex boards 42*a*, 42*b* are located at the rear side, and the side of lamp 30, and they reflect catoptric light from the rear reflex boards 41*a*, 41*b* onto an irradiation surface 33. Side reflex boards 43*a*, 43*b* are located at the side of lamp 30, and they reflect light 32*a*, 32*b* radiated from the side of lamp 30 onto an irradiation surface 33. The irradiation surface 33 can be, for example, where the paper 3 conveyed.

There are rear reflex boards 41*a*, 41*b*, rear-side reflex boards 42*a*, 42*b*, and side reflex boards 43*a*, 43*b* which are formed by parts of arcs so as to be concave mirrors to reflect incident light. The direction and position of each reflex board is set so that no shadows occur in incident light from the lamp 30. Furthermore, it is preferable that these reflex boards are aluminum boards with high reflectivity, thin boards having a flat surface with a coating of titanium nitride or metal film. The width of the rear-side reflex board 42*a* is expressed by the following equation established according to the diameter D of the lamp 30, and which is 28% narrower than the conventional structure:

$$W=2.26D \tag{5}$$

The height H from irradiation surface 33 to the rear reflex board 41*a* is expressed by the following equation:

$$H=2.42D \tag{6}$$

Figure 18:
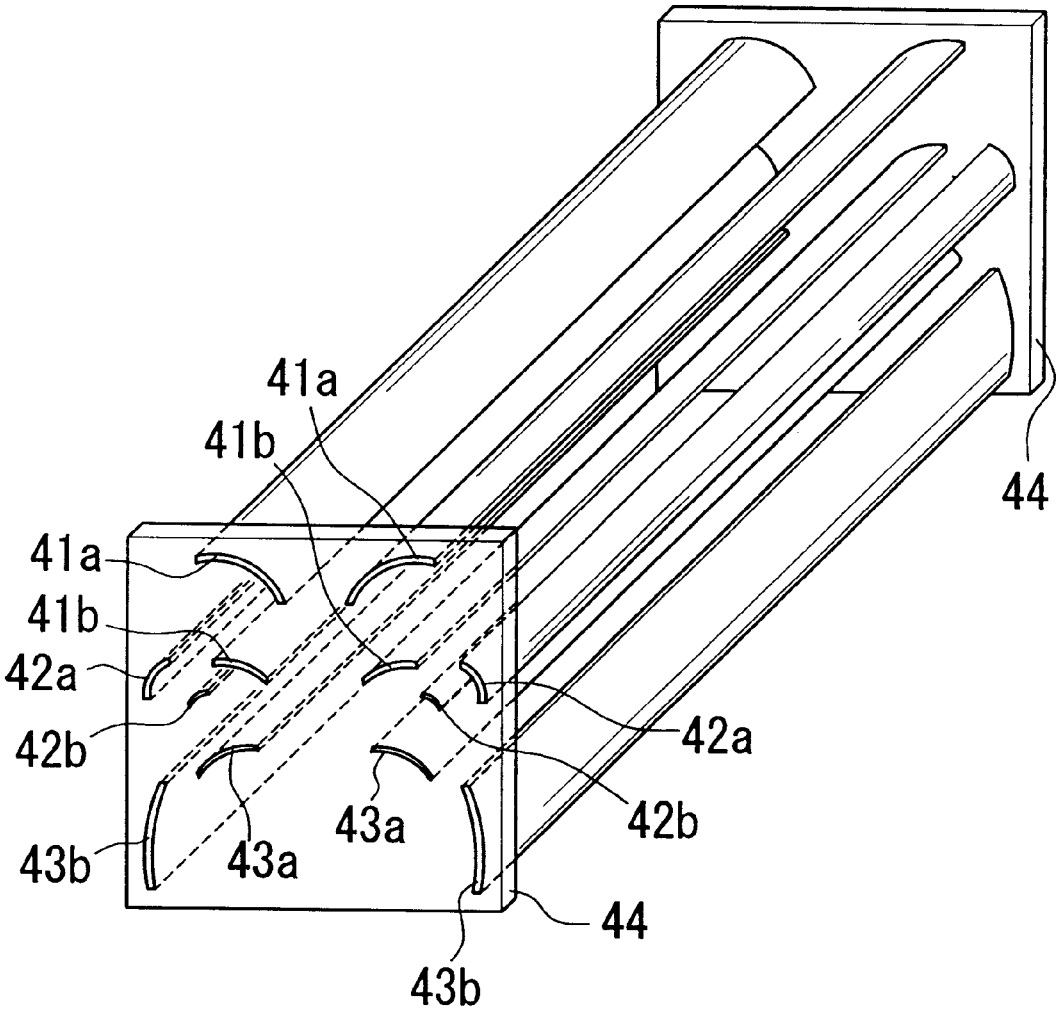
FIG. 18 shows a reflection unit of the sixth embodiment in perspective view.

FIG. 18 shows a reflection unit of the sixth embodiment in a squint view. The reflection unit has frame 44 fixed at both ends of the rear reflex board 41*a*, 41*b*, the rearside reflex boards 42*a*, 42*b*, and the side reflex boards 43*a*, 43*b*. The frame 44 is made from molded plastic or press-formed metal.

The following describes the working of the lamp reflex board of the sixth embodiment. The rear reflex boards 41*a*, 41*b* and the rear-side reflex boards 42*a*, 42*b* reflect radiant light 31*a*, 31*b* from the rear of lamp 30, and radiant light 31*a*, 31*b* reaches the irradiation surface 33. The side reflex boards 43*a*, 43*b* reflex radiant light 32*a*, 32*b* from the side of lamp 30 and radiant light 32*a*, 32*b* reaches the irradiation surface 33. In this way, radiant light from lamp 30 reaches the irradiation surface 33 efficiently. It is noted that the rear radiant light 31*a*, 31*b* is located between 135 degrees and 180 degrees of radiant angle ψ from the lamp 30, and the side radiant light 32*a*, 32*b* is located between 75 degrees and 135 degrees of radiant angle ψ from the lamp 30. Radiant angle ψ from the lamp 30 is defined so that the vertical direction of the irradiation surface 33 set to 0 degrees.

The following describes is the lamp cooling mechanism of the lamp reflex board of the sixth embodiment. The most efficient radiation of light by the lamp is at a temperature range of about 40 degrees centigrade. A conventional lamp requires air cooling by a fan, because the reflex board and the thermal paper enclose the lamp 30, and the temperature of the lamp 30 will become high without cooling. It is necessary to ventilate the lamp 30 through small gaps between the reflex board and the thermal paper. This leads to low cooling efficiency, and generates a temperature difference between the areas well ventilated with cooling ail and areas poorly ventilated with cooling air such as the rear of lamp 30.

The merit of the sixth embodiment is that the rear of the reflex board is well ventilated with cooling air, because the lamp reflex board is divided into three portions, such as the rear reflex boards 41*a*, 41*b*, rear-side reflex boards 42*a*, 42*b*, and side reflex boards 43*a*, 43*b*. This provides high cooling efficiency of the lamp, and inhibits local temperature differences. Even by air cooling without a blower, there is natural convection between the reflex boards, which provides high cooling efficiency of the lamp with an even temperature.

Although in the sixth embodiment, the lamp reflex board is divided into six portions on either the right or left side, such as rear reflex boards 41*a*, 41*b*, rear-side reflex boards 42*a*, 42*b*, and side reflex boards 43*a*, 43*b*. Those skilled in the art know that the number of divided portions of the lamp reflex board is not limited the above-mentioned six, but ten or more divided portions would also be acceptable. The shape of the lamp reflex board is not limited to arcs and flat boards, but polyhedrons, and minor ellipsoid concave would also be acceptable.

Another the merit of the sixth embodiment is that the width of the lamp reflex board is smaller than the conventional reflection surface of a concave mirror, because the divided reflex boards can be laid out separately. The separate reflex boards comprise rear reflex boards, rear-side reflex boards, and side reflex boards. The rear reflex boards are located at the back of the lamp, and it reflects radiant light from the back of the lamp to the side of the lamp. The rear-side reflex boards are located at the back and the side of lamp, and it reflect catoptric light from the rear reflex board to the irradiation surface. The side reflex boards are located at the side of lamp, and it reflect radiant light from the side of the lamp to the irradiation surface.

We claim:

1. A method of paper feeding from a roll in a color printer for automatic printing sequentially at each of a plurality of recording portions in which a specific color is applied comprising the steps of:

conveying the paper end from a roll by feed rollers to the plural recording portions sequentially, printing at each recording portion a specific color on said recording paper beginning at the paper end;

applying tension to the paper by tension roller while the printing takes place at each recording portion; and switching the tension being applied to a predetermined value at each said recording portion each time said recording paper is conveyed to each recording portion when starting to print.

2. The method of claim 1, wherein the tension at the recording portion located furthest downstream of the paper roll is switched so as to set it to be larger than the tension at a recording portion upstream.

3. The method of claim 1, wherein the tensions at said recording portions are set to make a conveyance length of said recording paper at the recording portions longer than a conveyance length provided by said feed roller.

4. The method of claim 1, wherein said recording portions further comprise an overcoat portion to overcoat said recording paper printed with a said specific colors and located downstream of said plural recording portions; and the step of switching the tension applied to said recording paper is carried out when said recording paper is conveyed to said overcoat portion.

5. The method of claim 1, wherein each of said recording portions comprise a thermal head and an ink ribbon of a single color.

6. The method of claim 1, wherein said recording paper is thermal paper; and the tension acting on said recording paper is switched when said recording paper is provided with a gloss surface through heat treatment applied to said recording paper downstream of said recording portions.

7. A method of paper feeding in a color printer in which recording paper is conveyed by feed rollers to plural recording portions sequentially, and each recording portion prints a specific color on said recording paper successively while applying tension, said method comprising the steps of:

applying tension to said recording paper by a tension roller, said tension being switched to a predetermined value each time said recording paper is conveyed to each recording portion when starting to print, wherein said recording portions further comprise:

a frictional force-detecting portion detecting a frictional force between a thermal head located on said recording portion and said recording paper during printing; and a driving force control portion controlling a driving force of a motor to balance said frictional force detected by said frictional force-detecting portion and the driving force of the motor driving said tension rollers; and the tension applied to said recording paper is switched by said driving force control portion each time a front edge of said recording paper is conveyed in sequence to each recording portion when starting to print.

8. A color printer comprising:

a feed roller conveying a recording paper;

plural recording portions located in the path of said paper downstream of said feed roller, and each printing a specific color ink on said paper;

tension rollers located downstream of each recording portion, and which convey said recording paper from upstream to downstream by applying tension; and wherein the tension applied by the tension roller to said recording paper is switched to a predetermined value each time said recording paper is conveyed to each recording portion.

9. A color printer comprising, a feed roller conveying a recording paper;

plural recording portions located in the path of said paper downstream of said feed roller, and each printing a specific color ink on said paper;

tension rollers located downstream of each recording portion, and which convey said recording paper from upstream to downstream by applying tension;

a frictional force-detecting portion detecting a frictional force between a thermal head located on said recording portion and said recording paper during printing; and a driving force control portion controlling a driving force of a motor to balance said frictional force detected by said frictional force-detecting portion and the diving force of the motor driving said tension rollers.

* * * * *